US006814658B1

(12) United States Patent
Rindoks et al.

(10) Patent No.: US 6,814,658 B1
(45) Date of Patent: Nov. 9, 2004

(54) AUTOMATIC SASH RETURN FOR WORK CHAMBER

(75) Inventors: Kurt P. Rindoks, Davidson, NC (US); Rudolph Poblete, Statesville, NC (US)

(73) Assignee: Kewaunee Scientific Corporation, Statesville, NC (US)

( * ) Notice: Subject to any disclaimer, the term of this patent is extended or adjusted under 35 U.S.C. 154(b) by 0 days.

(21) Appl. No.: 10/617,432

(22) Filed: Jul. 11, 2003

(51) Int. Cl.[7] ..... B08B 15/02
(52) U.S. Cl. ..... 454/63; 454/56; 49/445
(58) Field of Search ..... 454/49, 56, 63; 49/425, 445, 447

(56) References Cited

U.S. PATENT DOCUMENTS

| | | | | |
|---|---|---|---|---|
| 4,150,606 A | | 4/1979 | Nelson | 98/115 |
| 4,502,375 A | | 3/1985 | Hignite et al. | 98/115.3 |
| 4,774,878 A | | 10/1988 | Berlin et al. | 98/115.3 |
| 5,605,013 A | | 2/1997 | Hogston | 49/31 |
| 5,688,168 A | | 11/1997 | Schlies | 454/56 |
| 5,759,096 A | | 6/1998 | Berlin et al. | 454/56 |
| 6,024,638 A | | 2/2000 | Berlin et al. | 454/56 |
| 6,243,988 B1 | * | 6/2001 | Salice | 49/445 |
| 6,350,194 B1 | * | 2/2002 | Haugen et al. | 454/56 |

* cited by examiner

*Primary Examiner*—Derek S. Boles
(74) *Attorney, Agent, or Firm*—Kennedy Covington Lobdel & Hickman, LLP

(57) ABSTRACT

A counterweight apparatus is provided for automatically self-returning an enclosure sash or other closure member to at least one preselected intermediate position when released after being opened beyond that intermediate position and for selectively maintaining the closure member in at-rest positions, when released, between that intermediate position and a fully closed position.

57 Claims, 25 Drawing Sheets

AUTOMATIC SASH RETURN FOR WORK CHAMBER

BACKGROUND OF THE INVENTION

The present invention relates generally to counter-balance mechanisms for automatically controlling the opening or closing movement of sashes, doors or other closure members on housings or enclosures. More particularly, the invention relates to such counterbalance mechanisms that are especially well-suited for use in fume hoods, laboratory station enclosures, work chambers or other such housings or enclosures having systems for ventilating or exhausting their interiors.

Laboratory fume hoods and other such work station enclosures generally include a housing or other enclosed interior having an opening providing the user with access for performing various operations within an interior work chamber. Typically, a sash, door or other closure member is movably disposed within the access opening for opening or closing the enclosure. Because the operations conducted in such interiors often involve undesirable gases, fumes or vapors, these enclosures frequently include an exhaust conduit communicating the interior work space with a blower or other gas conveying device for removing such gases, fumes or vapors and for substantially preventing their escape into the surrounding environment.

In addition to the above components, these fume hoods or work enclosures typically include one or more counterweights that counterbalance the weight of the sash and any other forces tending to close the sash or door, thus allowing it to stay in a selected position when released by the operator. These counterbalance systems can include spring members that counterbalance the weight of the sash and can include sash weights hidden within the frame of the fume hood and cables that extend over pulleys and interconnect the sash or other closure member with the counterweights.

In many laboratories or other such facilities, fume hood enclosures are required to be large in order to allow relatively large equipment to be freely inserted into the interior work chamber. However, these configurations have resulted in unduly expensive exhaust equipment and high operating costs needed for exhausting the interior work chamber and maintaining it at a lower pressure than that of the surrounding environment due to the large access openings. These expenses have also been aggravated by the operating costs associated with replacing and reconditioning relatively large amounts of conditioned air from the surrounding environment that was lost by way of the large fume hood access opening and the exhaust system. In addition, although most users typically open fume hood sashes only enough to provide adequate access for performing the desired operations, these closure members are sometimes inadvertently left fully open or near fully open, in an at-rest position, after the user has completed the operations and vacated the area, thus further contributing to such increased expenses and costs.

In order to eliminate or substantially minimize these problems, a number of prior art devices have been proposed for automatically returning sashes or other closure members to either closed or minimally open positions. These solutions, however, have often involved tandem or multiple counterweight arrangements, and sensor-activated motorized closing equipment, for example, and thus have proved to be too complex, expensive or otherwise disadvantageous to be either effective or cost-justified in many fume hood or work chamber applications.

One such prior art device is disclosed in Schiles U.S. Pat. No. 5,688,168. In this patent the counterweight system includes a primary counterweight and a second adjusting weight. The second adjusting weight is arranged to add to the weight of this primary counterweight during certain movement of the sash to thereby allow the sash member to drop to a predetermined position after it is raised above that point. The second adjusting weight is dropped off of the primary counterweight during other movement of the sash.

One major disadvantage of this system is that the adjusting weight and the primary counterweight are both static, and the weight adjustment can be made at only one finish point during the vertical movement of the sash.

The present invention seeks to overcome these and other disadvantages and to further improve on prior art devices.

SUMMARY OF THE INVENTION

All embodiments of the present invention include an enclosure having an interior chamber, an access opening in the enclosure providing access to the interior chamber, a closure member movable between closed and fully open positions in the access opening for selectively allowing and restricting access to the interior chamber. The present invention relates to improvements in the counterweight system used with the closure member.

One series of embodiments of the present invention relate to an apparatus and method for uniquely using force moments to vary the effective weight of the counterweight and control the movement of a closure member, such as the sash of a fume hood. The first of these embodiments includes at least one primary counterweight, a primary connecting member interconnecting the primary counterweight and the closure member for movement therewith, and a primary roller member mounted for rotation about an axis of rotation, the primary roller member being engaged by the primary connecting member intermediate the primary counterweight and the closure member for rotation by the primary connecting member in response to movement of the closure member. Additionally, this embodiment includes at least one secondary counterweight, a secondary roller member arranged to rotate with the first roller member, and a secondary connecting member interconnecting the secondary roller member and the secondary counterweight, the secondary member movably winding and unwinding on the secondary roller member in response to movement of the closure member. When the closure member is moved between its fully closed position and a predetermined intermediate position between the closed and fully open positions, the secondary connecting member winds and unwinds from the secondary roller member in a first moment-producing direction on the secondary roller member. When the closure member is moved between the its fully opened position and the intermediate position, the secondary connecting member winds and unwinds on the secondary roller member in a second moment-producing direction on the secondary roller member, the second moment producing direction being opposite to the aforesaid first moment-producing direction.

Preferably, the closure member is a sash member movable generally vertically between the fully closed and fully open positions, and the primary and secondary counterweights maintain the closure member in a substantial stationary at-rest condition when the closure member is located at its predetermined intermediate position between its fully open and fully closed positions. The connecting members may be a chain or toothed belt engaging the outer periphery of teeth formed on pulleys, or a cable having one end fixedly interconnected to a pulley, or a cable having a traction-surface thereon for positively engaging a pulley. The primary and secondary pulleys may have diameters which are the same or different from one another.

The primary counterweight may be a single u-shaped weight, or a plurality of weights, each connected to the closure member by a separate connecting member, and some or all of the rollers may be pulleys that are connected together by a shaft for rotation about the axis of rotation of the shaft. The secondary counterweight may be attached to the shaft at a position intermediate the point at which two primary counterweights engage the shaft. Alternatively, the primary and secondary pulleys may be joined integrally as a double-grooved pulley mounted for rotation about an axis of rotation.

In another embodiment of the present invention generally similar the first embodiment described above, at least one primary counterweight is used as in the first embodiment described above. This embodiment also includes a pair of secondary counterweights, a respective pair of secondary roller members rotatably fixed relative to the primary roller member for rotation therewith, and a pair of respective secondary connecting members each having an end portion fixedly interconnected with a respective one of the secondary roller members and an opposite end portion fixedly interconnected with a respective one of the secondary counterweights. The secondary connecting members wind and unwind on the secondary roller members in response to movement of the closure member. In this embodiment, the closure member is movable to first and second predetermined intermediate positions between the fully closed and fully open positions, with each of the secondary members movably unwinding in a first moment-producing direction on one of the respective secondary roller members, when the closure member is moved between its fully closed position and the first intermediate position. One of the secondary connecting members winds and unwinds in the first moment-producing direction on one of the respective secondary roller members and the other of the secondary connecting members winds and unwinds in a, second opposite moment-producing direction on the other of the respective secondary roller members when the closure member is moved between the first intermediate position and the second intermediate position. Both of the secondary connecting members wind and unwind in the second moment-producing direction on the respective secondary roller members when the closure member is moved between the second intermediate position and the fully open position. Preferably, the secondary counterweights produce respective opening moments assisting the opening movement of the closure member when the respective secondary connecting members wrap and unwrap on the respective secondary roller members in the first moment-produce direction, and produce second respective closing moments assisting the closing movement of the closure member when the respective secondary connecting members wrap and unwrap on the respective secondary roller members in the second opposite moment-producing direction. It is also preferable that the primary and secondary counterweights maintain the closure member in a substantial stationary at-rest condition when the closure member is at a first predetermined intermediate position between the fully closed position and the fully open position.

Another series of embodiments of the present invention include an apparatus and method of utilizing a unique arrangement for varying the effective weight of the counterweight using vectoring of the forces applied by the counterweight to control the movement of the closure member. One of these embodiments includes at least one counterweight, at least two connecting members, each interconnecting the counterweight and the closure member, and at least two guide members disposed between the counterweight and the closure member. The two connecting members extend over the two guide members, respectively, so that the counterweight and the closure member move together in opposite vertical directions, with the two guide members being positioned so that the portions of the two connecting members extending between the support members and the closure member extend at an angle to vertical that varies as the closure member moves between the closed and fully open position to thereby vary the effective vertical counterweight forces exerted on the closure member by the counterweight. Preferably, the two guide members are rollers spaced from one another, and the closure member moves in a vertical path of movement that is between the rollers. It is also preferred that the effective vertical counterweight force is equal to the weight of the closure member when the closure member is moved to a predetermined intermediate position between the fully open and fully closed position of the closure member.

Another embodiment of the present invention includes a counterweight, and a connecting member connecting the counterweight to the closure member. At least one guide member is disposed between the counterweight and the closure member with the connecting member extending over the guide member so that the counterweight and the closure member can move together in opposite vertical directions. A track member is disposed in the path of the vertical movement of the counterweight and extends at an angle to the vertical path of movement of the counterweight whereby the counterweight will engage the track member during a predetermined portion of its downward movement and will be moved at an angle away from the vertical path of movement to thereby vary the effective vertical counterweight force exerted on the closure member by the counterweight. Preferably, a rotatable engagement member, such as a roller, is mounted on the counterweight and positioned to rotatably engage the track member. The portion of the connecting member extending between the guide member and the counterweight extends in a vertical direction during movement of the counterweight when it is not in engagement with the track member, and extends at an angle to vertical when the counterweight is in engagement with the track member, such angle increasing as the counterweight moves downwardly along the track member. It is also preferable that two guide members and two connecting members be provided, with the guide members located vertically above the counterweight so that the portions of the connecting members extending between the guide members and the counterweight will extend in a vertical direction during movement of the counterweight when it is not in engagement with the track member and will extend at an angle to vertical when the counterweight is in engagement with the track member, this angle increasing as the counterweight moves downwardly along the track member.

In yet another embodiment of the present invention, a counterweight is provided, and a first connecting member connects the counterweight to the closure member. At least one guide member is disposed between the counterweight and the closure member with the first connecting member extending over the guide member so that the counterweight and the closure member can move together in opposite vertical directions. A second connecting member extends between the counterweight and a fixed element in the enclosure, the second connecting member having a fixed length. The fixed element is located to cause the second connecting member to move the counterweight at an angle away from the vertical direction of movement to thereby vary the effective vertical counterweight force exerted on the closure member by the counterweight. Preferably, the effective vertical counterweight force is varied to result in such force being less than the weight of the closure member when the closure member moves between the fully open position and a predetermined intermediate position between the fully closed and fully open positions, and to result in the such force being substantially equal to the weight of the closure member when it is at the predetermined intermediate position.

In another embodiment of the present invention, at least one counterweight is provided, and a pulley is located between the counterweight and the closure member. The pulley is formed with two sides that extend radially outwardly along gradually diverging extents to form a groove therebetween that gradually increases from the inner edge of the groove to the outermost edge of the pulley. A connecting member interconnects the closure member and the counterweight and is disposed in the groove of the pulley, and the connecting member is formed with a first segment having a first predetermined width joined to a second segment having a second predetermined width that is less that the first predetermined width, whereby the effective weight of the counterweight as applied to the weight of the closure member is varied depending on which of first or second segments are disposed in the groove of the pulley. Preferably, the first segment of the connecting member is joined to the second segment of the connecting member by an intermediate transition segment, and the intermediate transition segment is disposed within the groove of the pulley when the closure member is located at its predetermined intermediate position between its fully opened and fully closed positions.

Additional objects, advantages and features of the present invention will become apparent from the following description and the appended claims, taken in conjunction with the accompanying drawings.

DESCRIPTION OF THE PREFERRED EMBODIMENTS

Figure 1:
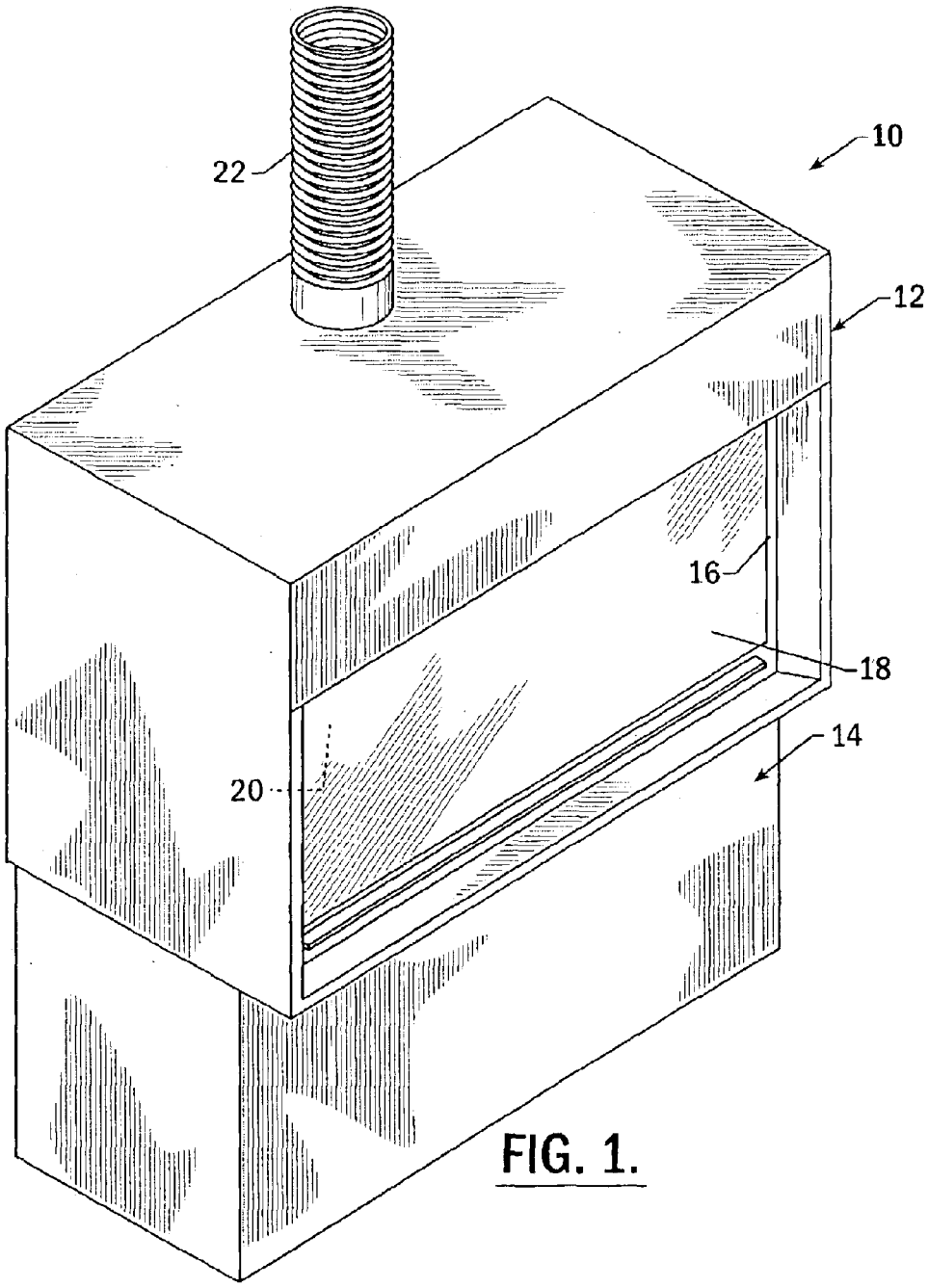
FIG. 1 is a perspective view of an exemplary fume hood enclosure having a sash counterbalance mechanism according to the present invention.

FIGS. 1 through 32 of the accompanying drawings depict various exemplary embodiments of a counterbalance mechanism for a vertically movable closure member, such as a sash, of a enclosure, such as a fume hood, according to the present invention. Such illustrations are shown for purposes of illustration, however, and one skilled in the art will readily recognize that still other alternate embodiments according to the invention can also be employed and that the invention can be equally and advantageously used in other door or closure member arrangements in other enclosure apparatuses.

Referring initially to FIGS. 1 through 4, an exemplary fume hood work station apparatus 10 is illustrated, and it generally includes a fume hood enclosure or housing 12 disposed upon a base 14 and having an access opening 16 and a movable door, sash or other closure member 18 for selectively providing access to an interior work chamber 20. An exhaust conduit 22 communicates with the interior chamber 20 and with a blower or other gas conveying device (not shown) for exhausting undesirable gases, fumes or vapors resulting from operations performed in the interior chamber. The exhaust conduit 22 also maintains a net negative pressure in the interior chamber 20 relative to the surrounding environment in order to substantially prevent the escape of such undesirable gases, fumes or vapors.

Figure 2:
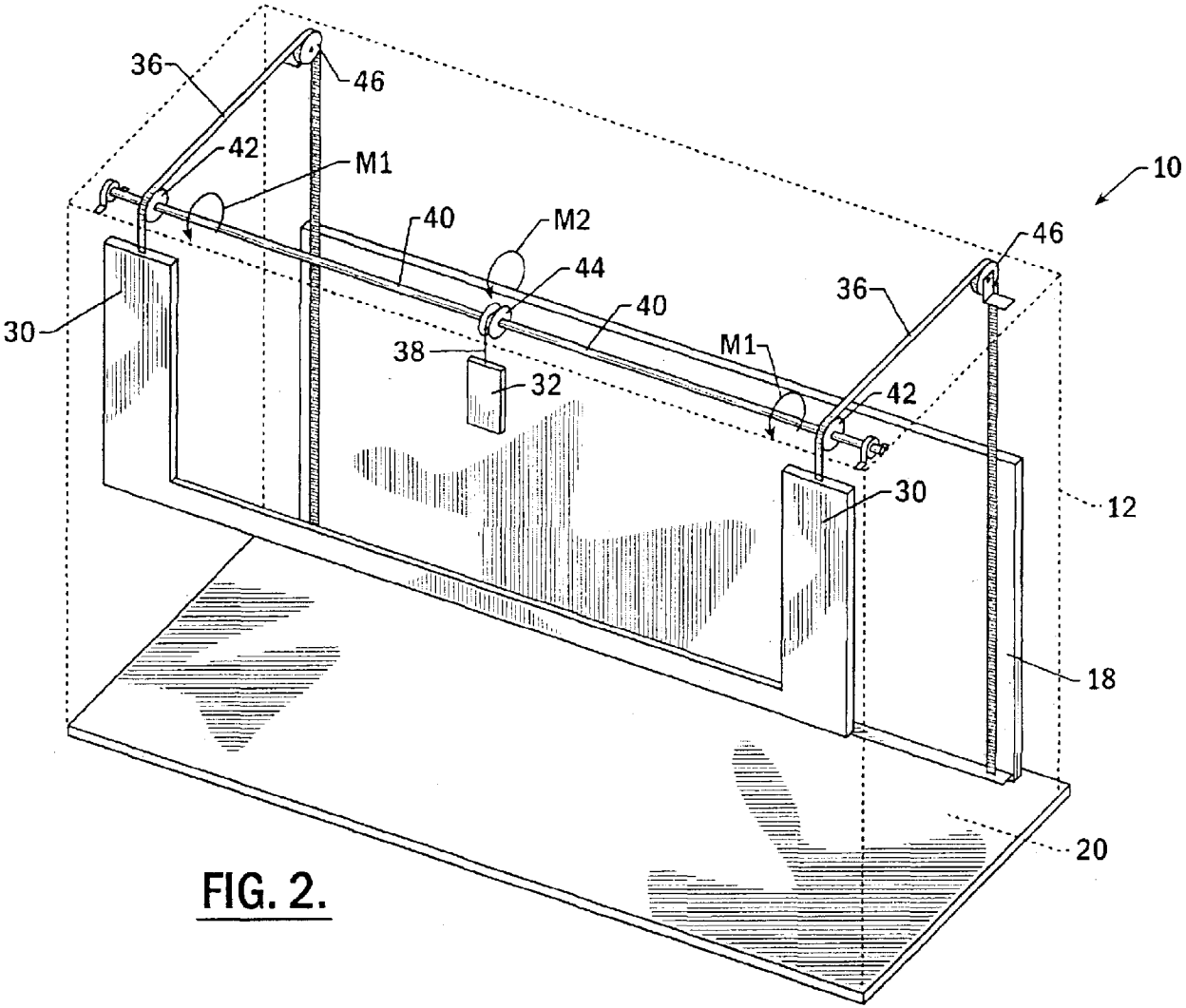
FIG. 2 is a diagrammatic illustration of a first embodiment of a sash counterbalance mechanism for the fume hood enclosure of FIG. 1, showing the sash in a fully closed position.
Figure 3:
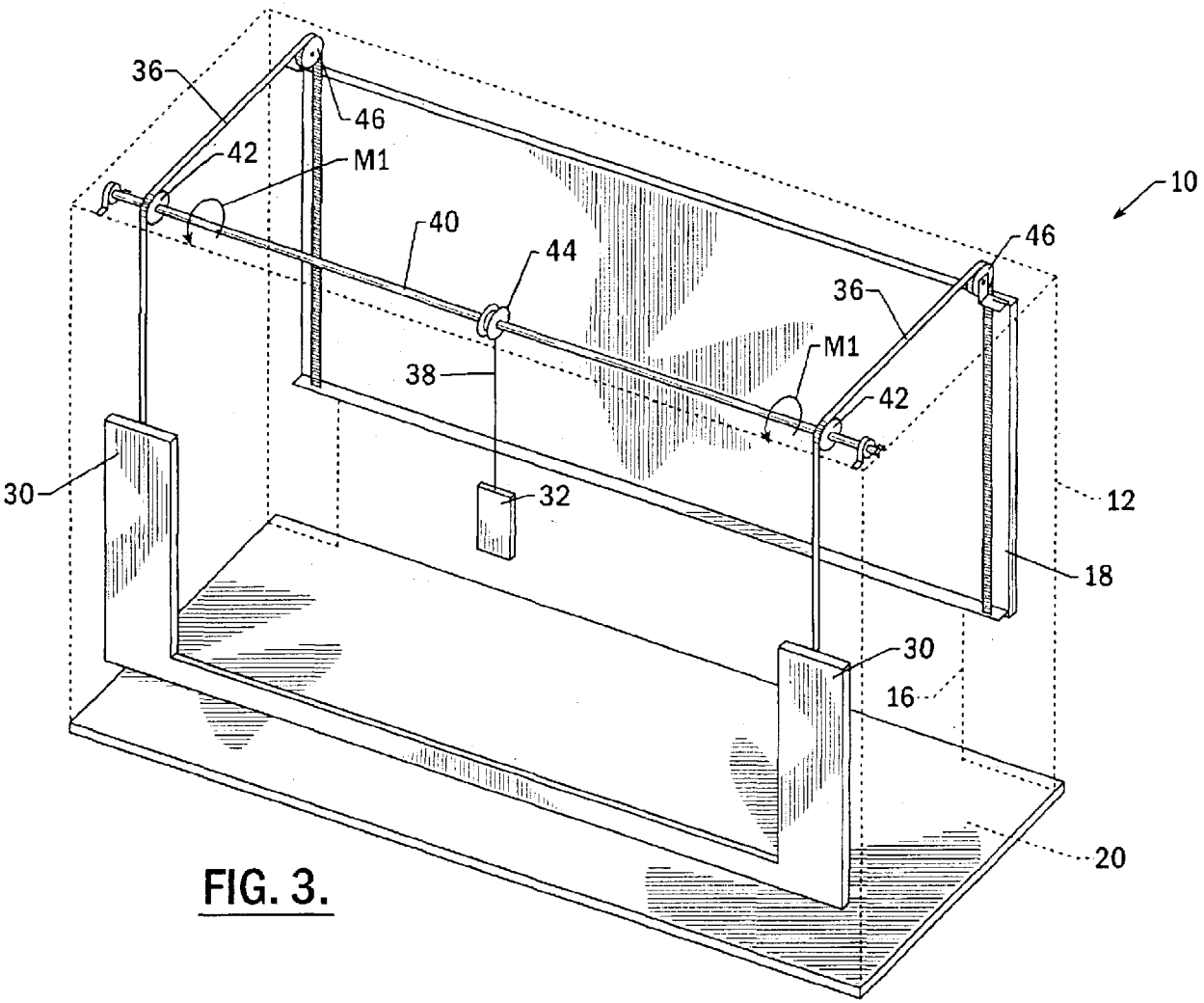
FIG. 3 is a diagrammatic illustration similar to FIG. 2, but showing the sash in an intermediate position.
Figure 4:
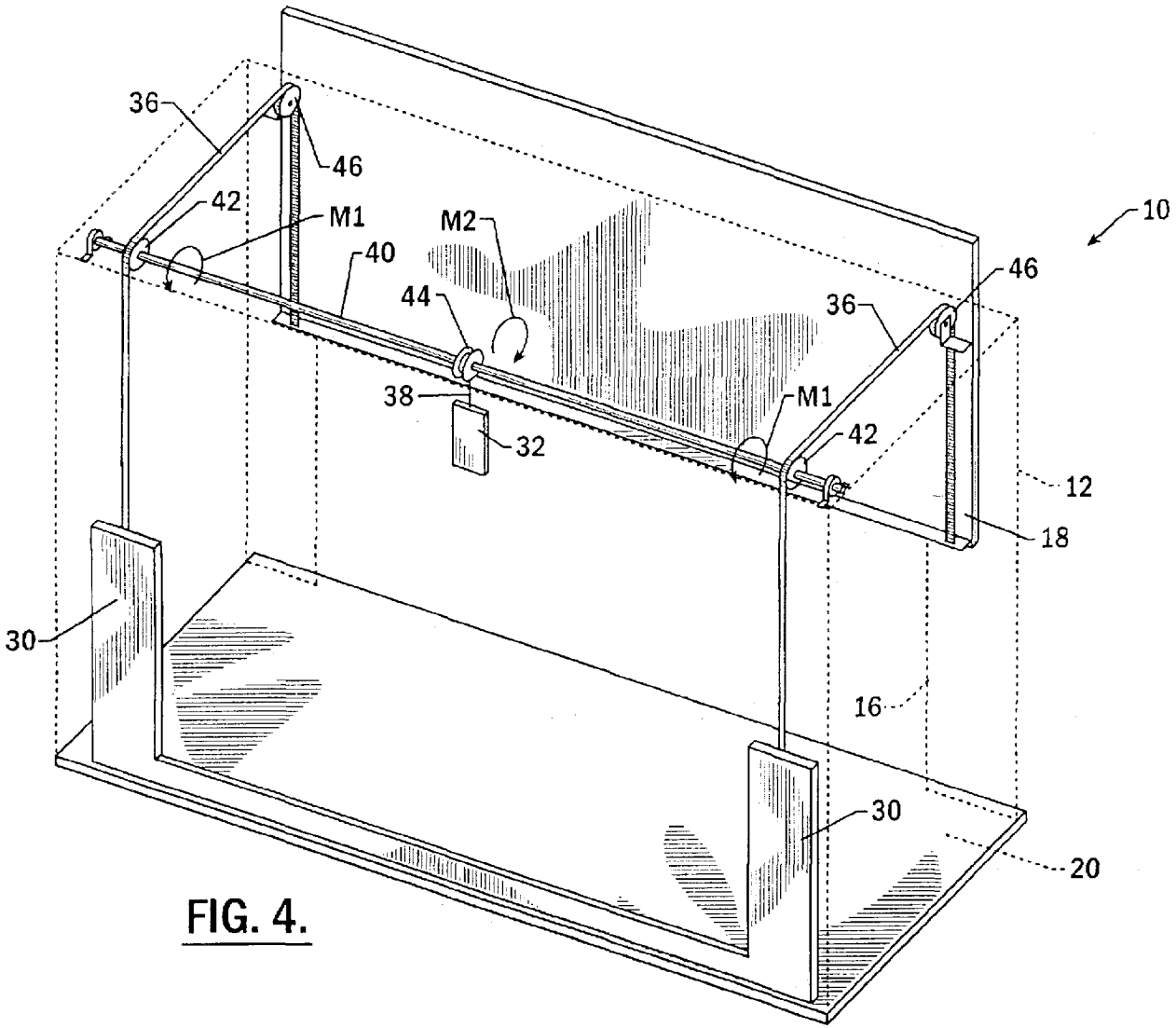
FIG. 4 is a diagrammatic illustration similar to FIG. 2, but showing the sash in a position opened beyond the above-mentioned intermediate position.

As best seen in FIGS. 2 through 4, the fume hood apparatus 10 preferably also includes a u-shaped counterweight 30 interconnected with the sash 18 by first belts, cables or other elongated connecting members 36, which movably engage respective sets of first pulleys or other roller members 42 and 46. The pulleys 42 are fixedly interconnected with a rotatable axle 40, or are formed integrally therewith, that extends across the width of the enclosure 12 such that the pulleys 42 and the axle 40 rotate together in response to opening or closing movement of the sash 18. The weight value of the primary counterweight 30 is selected so that it exerts moment M1 on the axle 40 in a sash-opening direction when the sash 18 is being opened, thus assisting in such opening movement.

The fume hood apparatus 10 preferably also includes at least one secondary counterweight 32 interconnected with the sash 18 by a second cable or other elongated connecting member 38, which is fixedly interconnected to, and winds and unwinds upon, a second pulley or other roller member 44. The second pulley 44 is also fixedly interconnected with the rotatable axle 40 such that the second pulley 44, the first pulleys 42 and the axle 40 rotate together in response to opening or closing movement of the sash 18. The weight value of the secondary counterweight 32 relative to the weight value of the primary counterweight 30, the length of the fixed-end cable 38, and the relative diameters (equal or unequal) of the pulleys 42 and 44 are selected so that they exert the desired values of the moments M1 and M2 on the axle 40 in a sash-opening direction when the sash 18 is being moved from its fully closed position illustrated in FIG. 2 to the predetermined intermediate position illustrated in FIG. 3, thus assisting in such opening movement.

When the sash 18 is raised to the predetermined intermediate position of FIG. 3, however, the second cable 38 has been substantially completely unwound (in such sash-opening direction) from the second pulley 44 such that the secondary counterweight 32 no longer exerts the above-mentioned moment M2 on the axle 40 in a sash-opening direction. Therefore, the sash 18 will remain at this predetermined intermediate position unless it is moved by an external force.

Further opening movement of the sash 18 toward the fully open position shown in FIG. 4 results in the second cable 38 winding onto the second pulley 44 in an opposite direction, thus allowing the secondary counterweight 32 to exert an opposite moment M2 on the axle 40 in a sash-closing direction. This sash-closing moment M2, acting along with the weight of the sash itself, overcomes oppositely-directed moments M1 exerted on the axle 40 by the primary counterweight 30 and causes the sash 18 to move in a closing direction toward the aforesaid predetermined intermediate position until the second cable 38 again unwinds completely. When the sash 18 reaches the predetermined intermediate position, the secondary counterweight 32 is not exerting any moment on the axle 40, and thus the sash 18 comes to a stop.

Further closing movement of the sash 18 causes the second cable 38 to again reverse direction and to wind onto the second pulley 44 such that it again exerts a moment M2 on the axle 40 in the same direction as those exerted on the axle 40 by the primary counterweights 30.

Thus, it will be seen from the above description that this embodiment of the present invention, the unique arrangement of the secondary counterweight 32 maintains the sash 18 at its predetermined intermediate position. If the sash is moved by an external force, in an upward direction, such as manually by the user of the fume hood apparatus 12, which would normally increase operating cost of the fume hood apparatus 12 as discussed above, the unique counterweight system of this embodiment of the present invention will automatically return the sash 18 to its desired predetermined intermediate position.

In the embodiment of the present invention illustrated in FIGS. 2 through 4, it will be understood that in virtually all applications of the present invention it is important that if the sash 18 is moved from its desired predetermined intermediate position to a more open position the sash 18 be immediately returned to the intermediate position. Moreover, the weight of the primary counterweights and/or the secondary counterweights can be selected to cause the sash to remain in an at-rest position at any location of the sash between its intermediate position and its fully closed position. Thus, in the embodiment of FIGS. 2 through 4 the moments M1 and M2 can be selected so that when combined they are substantially equal to the weight of the sash 18, in which case the sash 18 will remain at its at-rest position anywhere between its fully closed position in FIG. 2 and its predetermined intermediate position in FIG. 3. On the other hand, if desired, the combined moments M1 and M2 can be selected to be slightly greater that the weight of the sash 18, in which case the sash will always returned to its intermediate position whenever it is moved from its intermediate position toward its closed position. This alternate use of the weight of the primary and/or secondary counterweights is available in many of the embodiments of the present invention.

It would also be appreciated by those skilled in the art that the relative weight values of the primary counterweight 30 and the secondary counterweight 32, and the diameter of the pulleys 42 and 44, and the lengths of the connecting members 36 and 38 can be varied, as desired, to obtain other different operating characteristics for the system, depending on the particular application of the present invention. For example, and without limitation, the speed at which the sash 18 returns to its predetermined intermediate position can be varied by changing the weight of the secondary counterweight 32 and/or by varying the diameter of the pulley 44. This ability to readily vary the operating characteristics of the counterweight system can be applied not only to the first embodiment of the present invention as described above, but also to many of the remaining embodiments of the present invention described hereafter.

Figure 5:
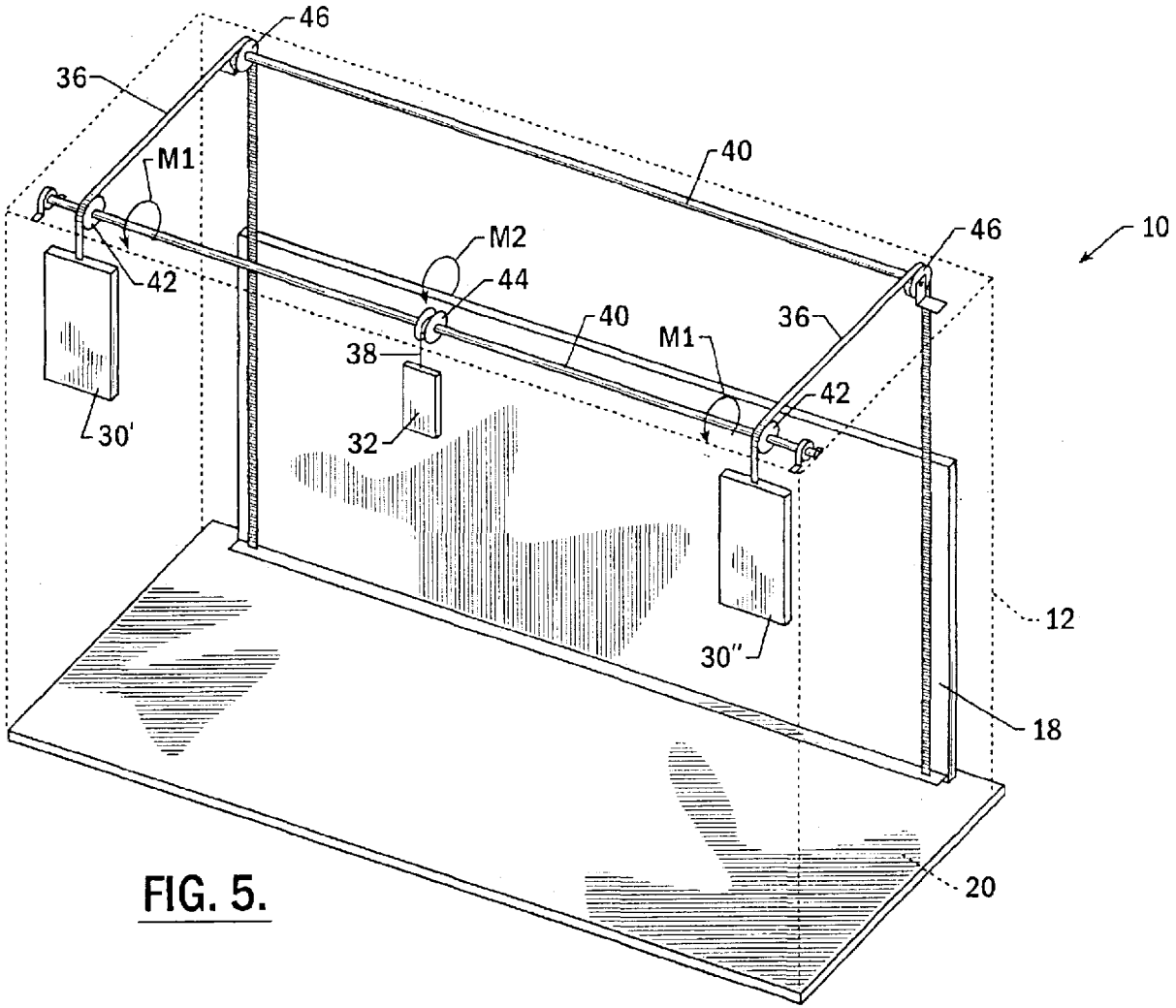
FIG. 5 is a diagrammatic illustration of another embodiment of a sash counterbalance mechanism similar to the embodiment illustrated in FIG. 2 but having a different counterweight arrangement.

FIG. 5 illustrates another embodiment of the invention that is similar to the embodiment in FIGS. 2 through 4 except that the primary counterweight consist of two separate counterweights 30' and 30" in place of a single u-shaped counterweight 30. Each of the counterweights 30' and 30" are mounted to a separate elongated connecting member 36. Also, in this embodiment of the invention, the back pulleys 46 are mounted for rotation together on a tube 40 in the same manner as the front pulleys 42.

Figure 6:
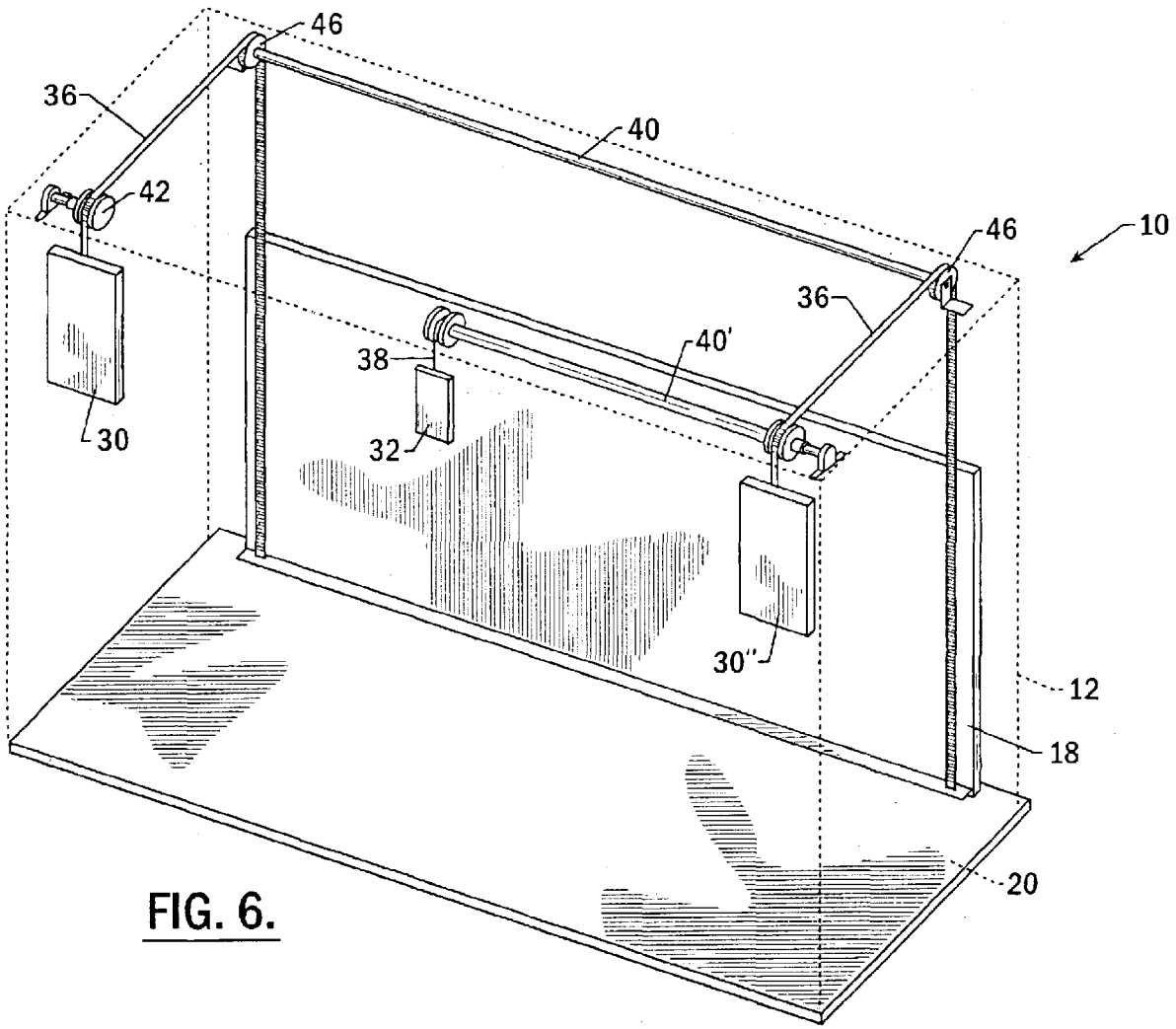
FIG. 6 is a diagrammatic illustration of yet another embodiment of a sash counterbalance mechanism similar to the mechanism illustrated in FIG. 5 but utilizing a modified pulley arrangement.

The embodiment in FIG. 6 is similar to that in FIG. 5 except that the back pulleys 46 are individually mounted for rotation, and one of the front pulleys 42 (e.g. the right-hand pulley 42) is mounted for rotation with the secondary counterweight 32 on a tube-type pulley shaft 40'.

Figure 7:
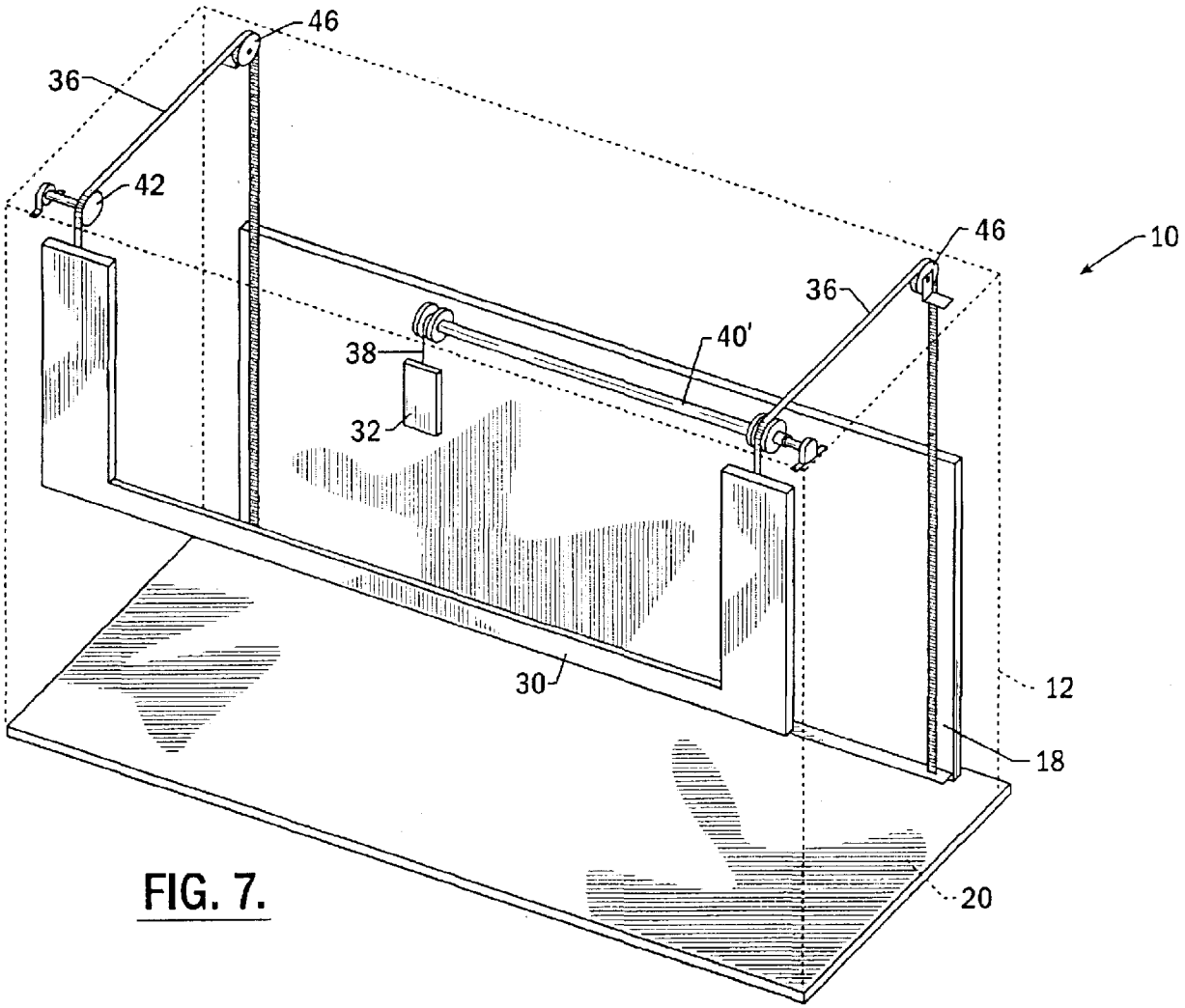
FIG. 7 is a diagrammatic illustration of yet another embodiment of a sash counterbalance mechanism similar to that illustrated in FIG. 2 but utilizing a modified pulley arrangement.
Figure 8:
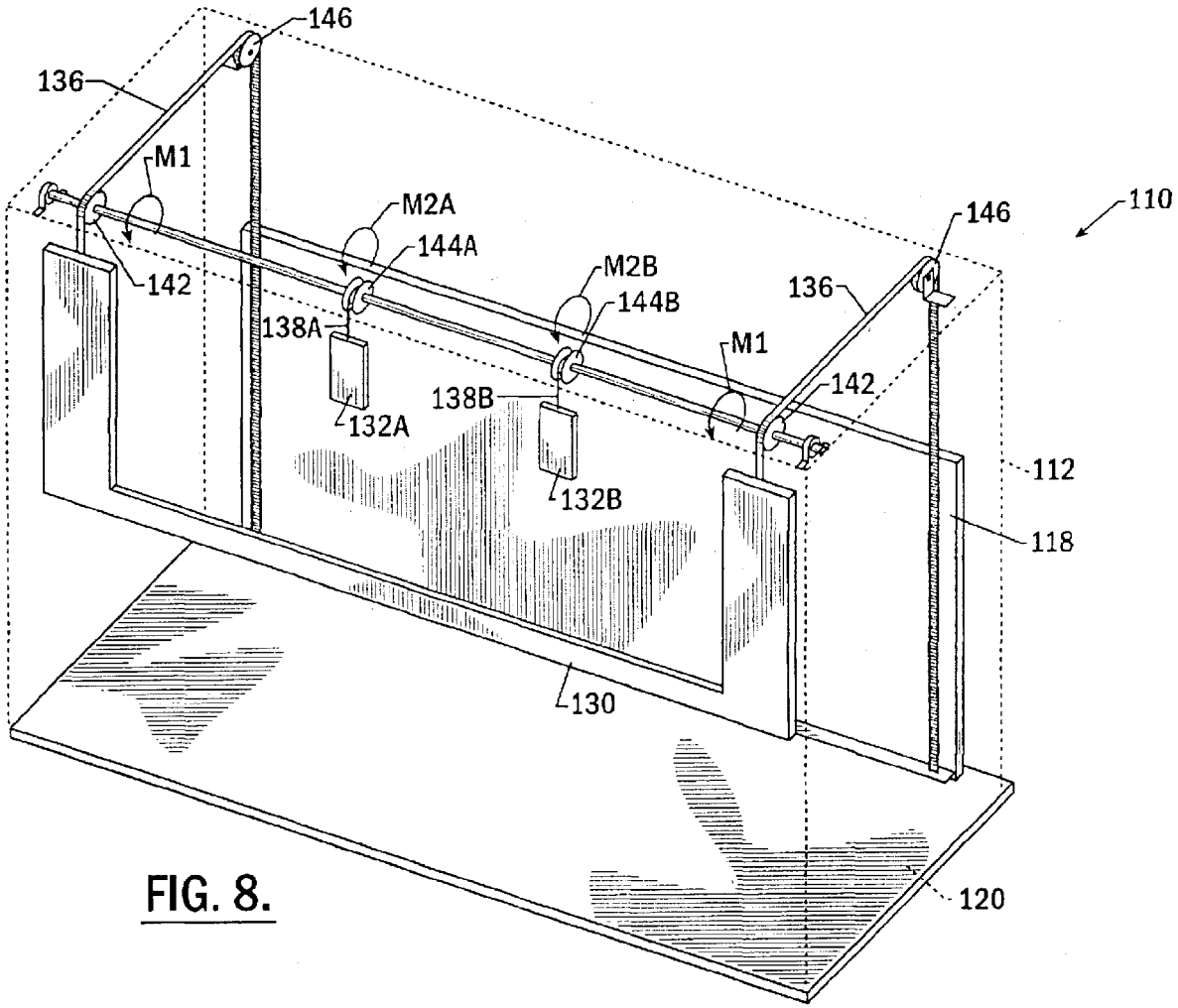
FIG. 8 is a diagrammatic illustration of another embodiment of a sash counterbalance mechanism for the fume hood enclosure of FIG. 1, showing the sash in a fully closed position.

The embodiment in FIG. 7 is similar to that in FIG. 6, except that the two separate counterweights 30' and 30" are replaced with a single u-shaped counterweight 30 like that in the embodiment of FIGS. 2 through 4.

In FIGS. 8 through 11, reference numerals are used to denote elements that are similar in configuration or function to those of FIGS. 1 through 4, except that the numerals in FIGS. 8 through 11 have "one-hundred prefixes". In FIGS. 8 through 11, a pair of secondary counterweights 132A and 132B are substituted for the single secondary counterweight 32 in FIGS. 2 through 4. The weight values of the secondary counterweights 132A and 132B, relative to the weight value of the primary counterweight 130, as well the respective lengths of the respective cables 138A and 138B and the relative diameters (equal or unequal) of the respective second pulleys 144A and 144B and the respective first pulleys 142A and 142B can be selected so that they both exert moments M2A and M2B on the axle 140 in a sash-opening direction when the sash 118 is being opened between the fully closed position of FIG. 8 and a first preselected intermediate position shown in FIG. 9, thus assisting in such opening movement.

Figure 9:
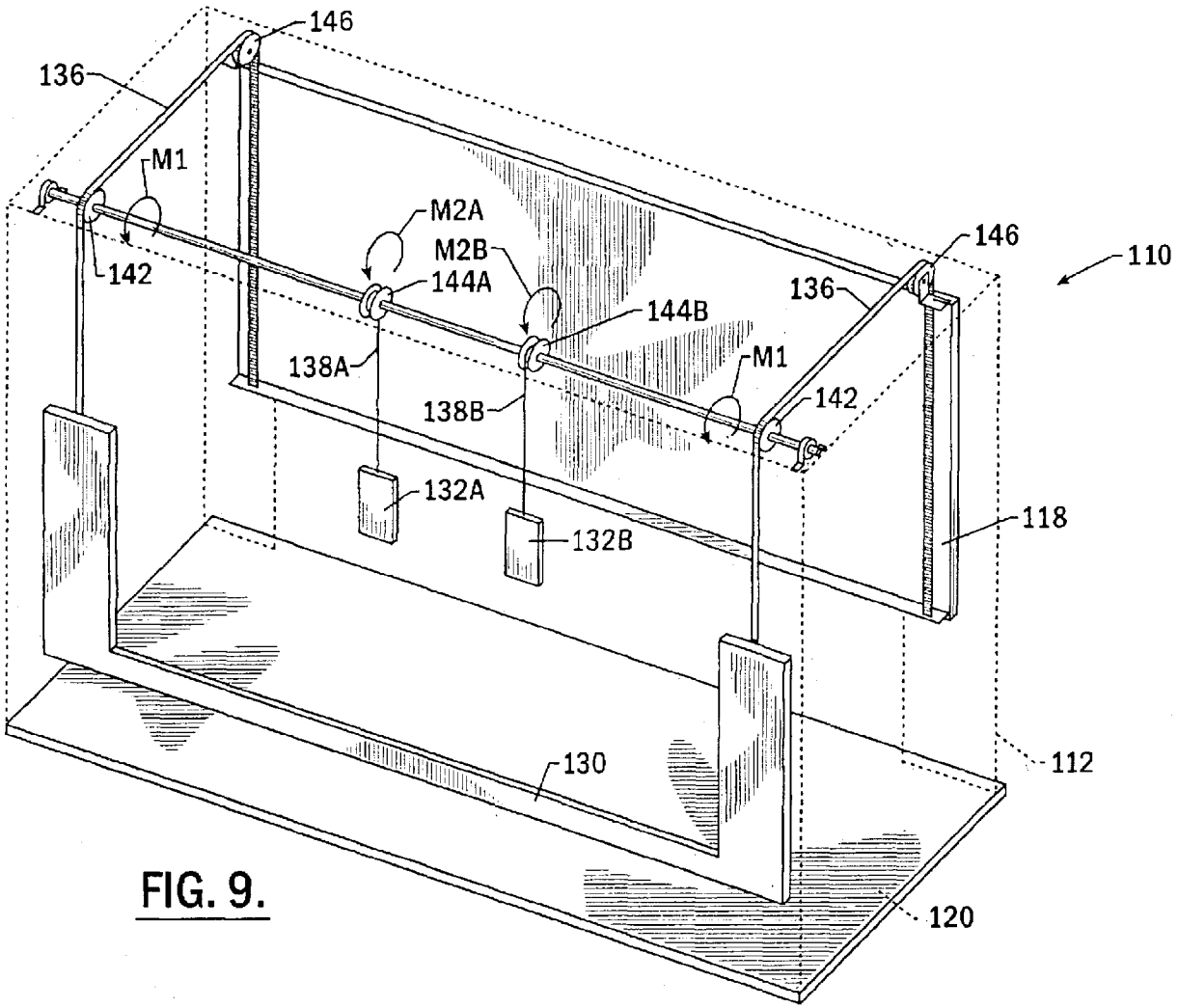
FIG. 9 is a diagrammatic illustration similar to FIG. 8, but showing the sash in a first intermediate position.

When the sash 118 is raised to the first predetermined intermediate position illustrated in FIG. 9, however, the second cable 138A will be substantially completely unwound (in such sash-opening direction) from the pulley 144A such that the secondary counterweight 132A no longer exerts the above-mentioned moment M2 on the axle 140 in a sash-opening direction.

Figure 10:
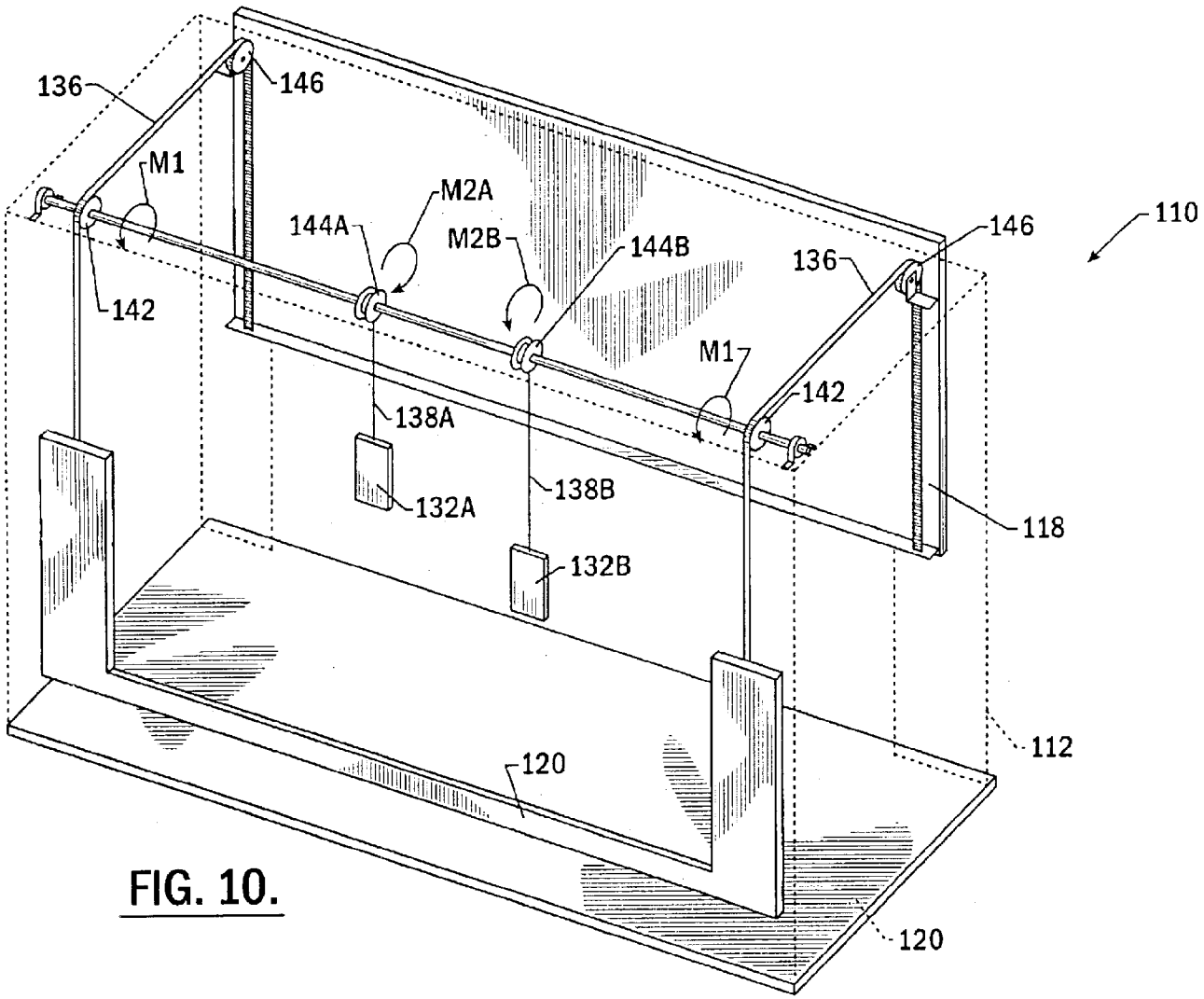
FIG. 10 is a diagrammatic illustration similar to FIG. 8, but showing the sash in a second intermediate position.

Further opening movement of the sash 118 toward a second preselected intermediate position shown in FIG. 10 results in the cable 138A winding onto the pulley 144A in an opposite direction, thus allowing the secondary counterweight 132A to now exert an opposite moment M2 on the axle 140 in a sash-closing direction. However, the second cable 138B will be substantially completely unwound (in such sash-opening direction) from the pulley 144B such that the secondary counterweight 132B no longer exerts the above-mentioned moment M2 on the axle 140 in a sash-opening direction. This sash closing moment M2 of the secondary counterweight 138A, acting along with the weight of the sash 118 itself, overcomes oppositely-directed moments M1 exerted on the axle 140 by the primary counterweight 130 and causes the sash 118 to move in a closing direction toward the first preselected intermediate position illustrated in FIG. 9.

Figure 11:
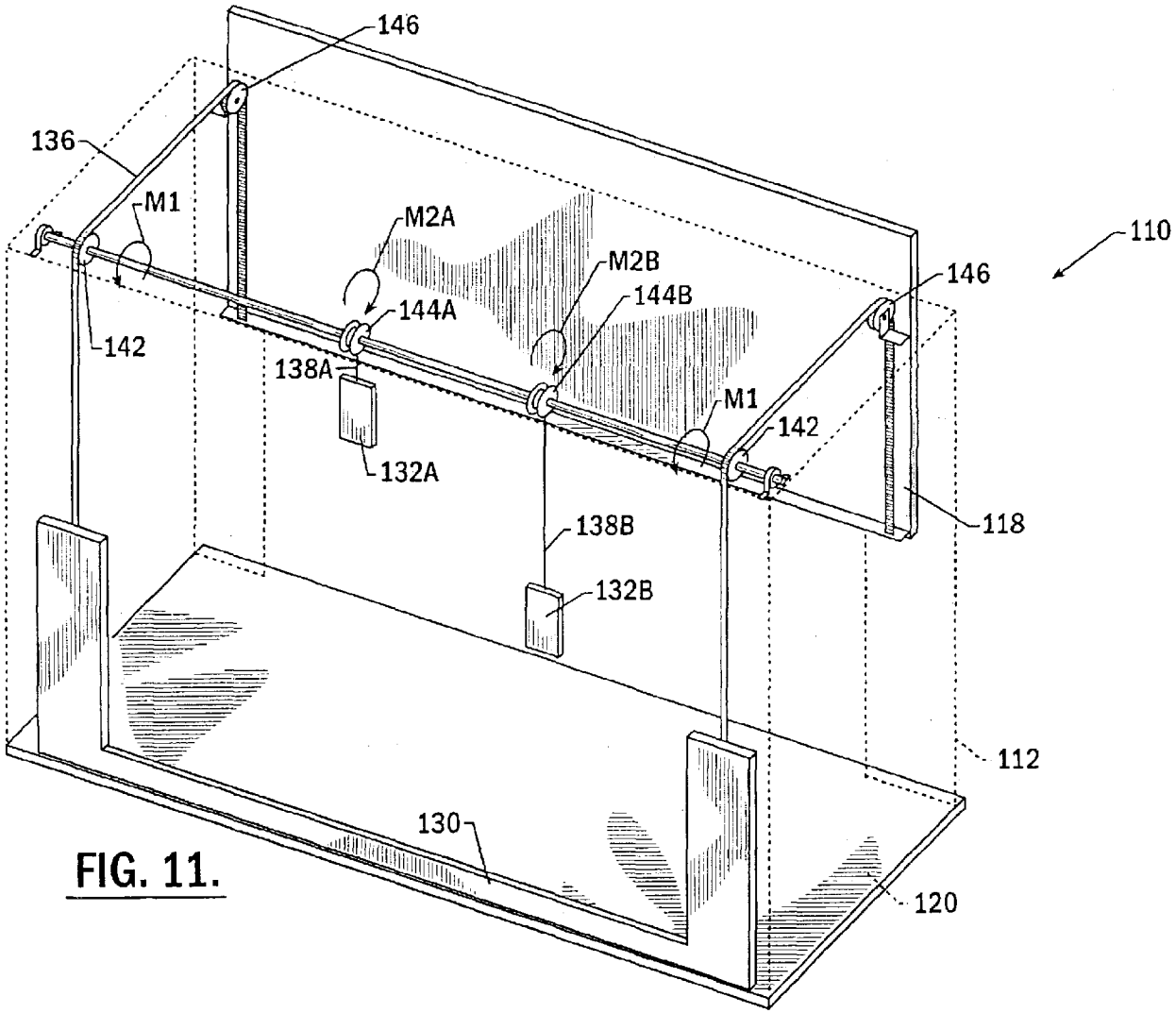
FIG. 11 is a diagrammatic illustration similar to FIG. 8, but showing the sash in a position opened beyond the above-mentioned first and second intermediate positions.

Still further opening movement of the sash 118 toward its fully open position illustrated in FIG. 11 results in the both of the second cables 138A and 138B winding onto the respective pulleys 144A and 144B in an opposite direction, thus allowing both secondary counterweights 132A and 132B to now exert moments M2A and M2B on the axle 140 in sash-closing directions. These further-increased sash-closing moments M2A and M2B of both secondary counterweights 138A and 138B, acting along with the weight of the sash itself, also cause the sash 118 (when released) to move in a closing direction toward the second preselected intermediate position illustrated in FIG. 10, but at a faster closing rate than when the sash 118 moves in a closing direction from this second intermediate position toward the first intermediate position of FIG. 9.

It should be noted that any number of first or secondary counterweight, cable and pulley combinations or arrangements can also be used to achieve even more varied closing speeds in even more sash position ranges or to achieve other performance characteristics.

Figure 12:
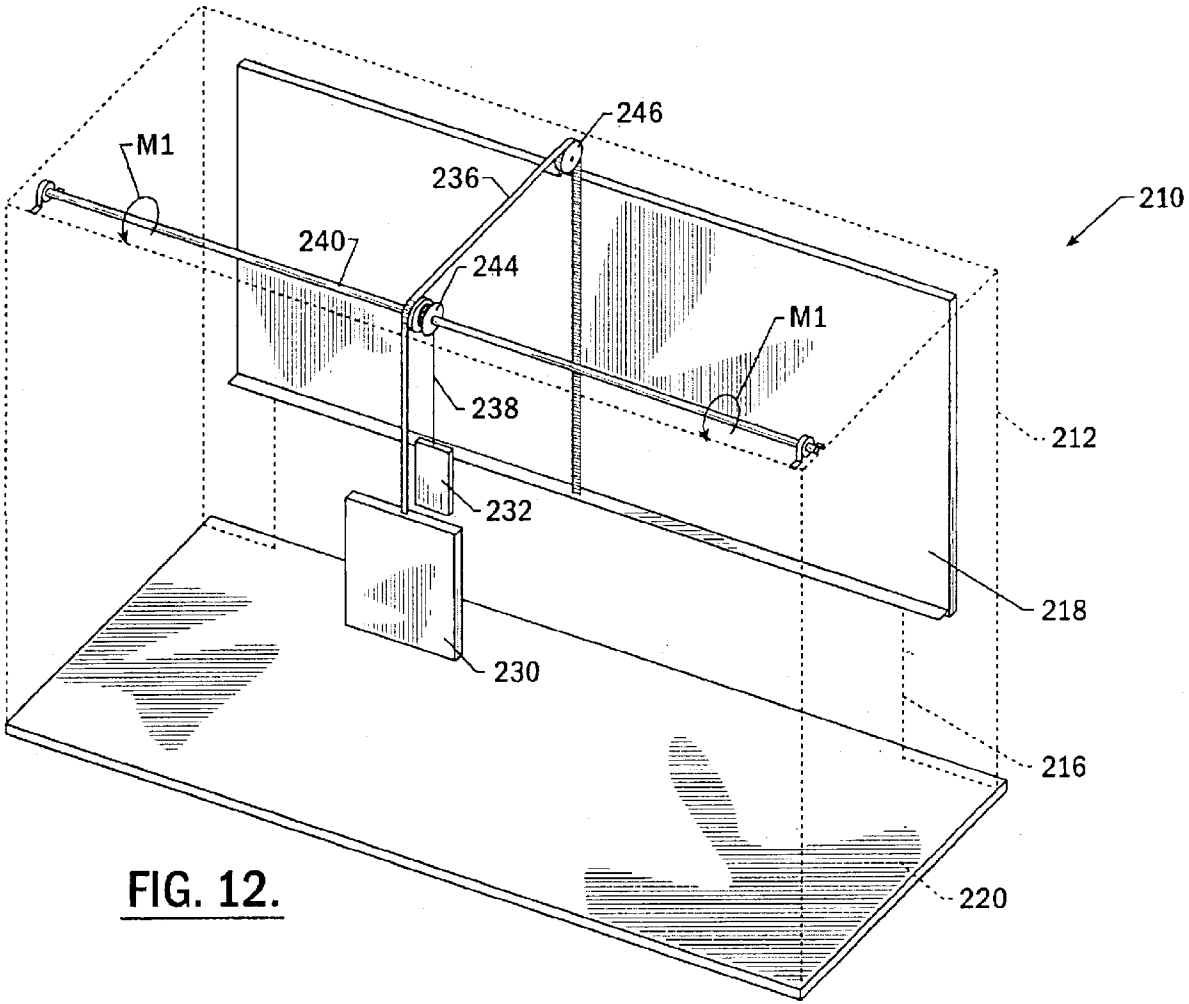
FIG. 12 is a diagrammatic illustration of yet another embodiment of a sash counterbalance mechanism for the fume hood enclosure of FIG. 1, having a generally centrally-located counterweight arrangement and showing the sash in a fully closed position.

FIG. 12 (in which "two-hundred prefixes" are used with corresponding reference numerals) illustrates an arrangement similar to that of FIGS. 2 through 4, except that the primary counterweight 230 is not u-shaped, and it is attached to a single first cable or connecting member 236 disposed at or near the width-wise center of the fume hood. Also both the first cable 236 and the second cable 238 may utilize a single double-shived pulley 244. Such an arrangement is particularly useful in smaller fume hoods 210, with lighter sashes 218, or where there is no need to support the sash 218 at both ends in order to avoid binding when it is opened or closed.

Figure 14:
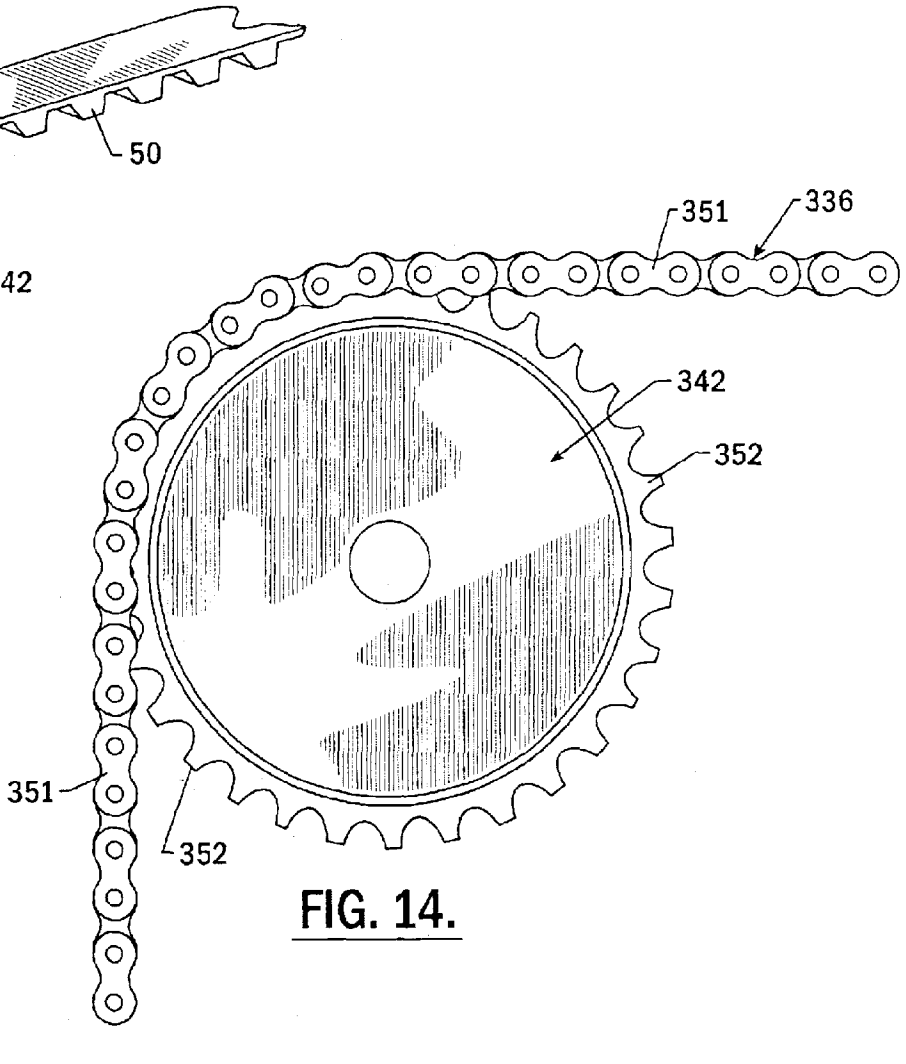
FIG. 14 is a detail view, similar to that of FIG. 13, but illustrating another alternate link and respective roller assembly including a chain enmeshed with a corresponding sprocket.
Figure 13:
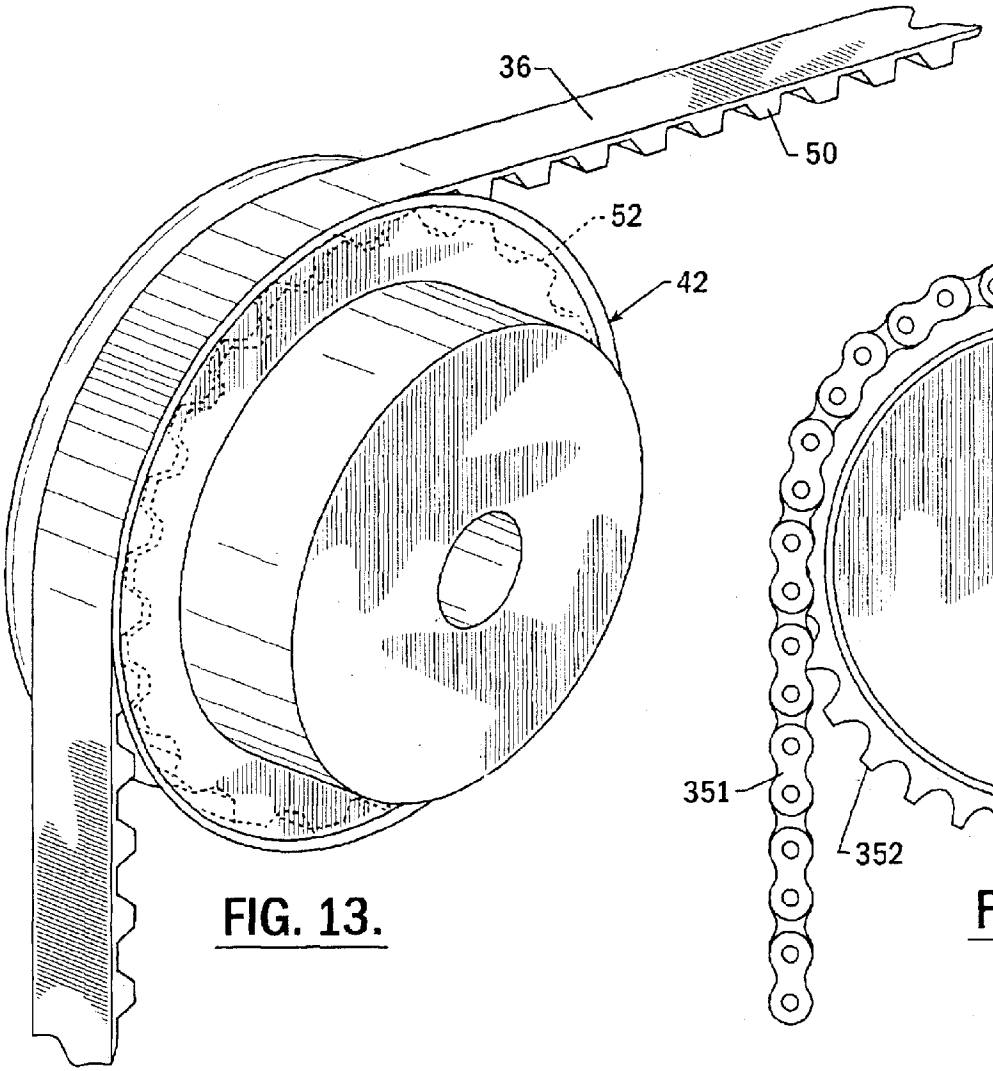
FIG. 13 is a detail view of one elongated link member and respective roller assembly including a toothed belt enmeshed with a correspondingly toothed pulley.
Figures 15, 16:
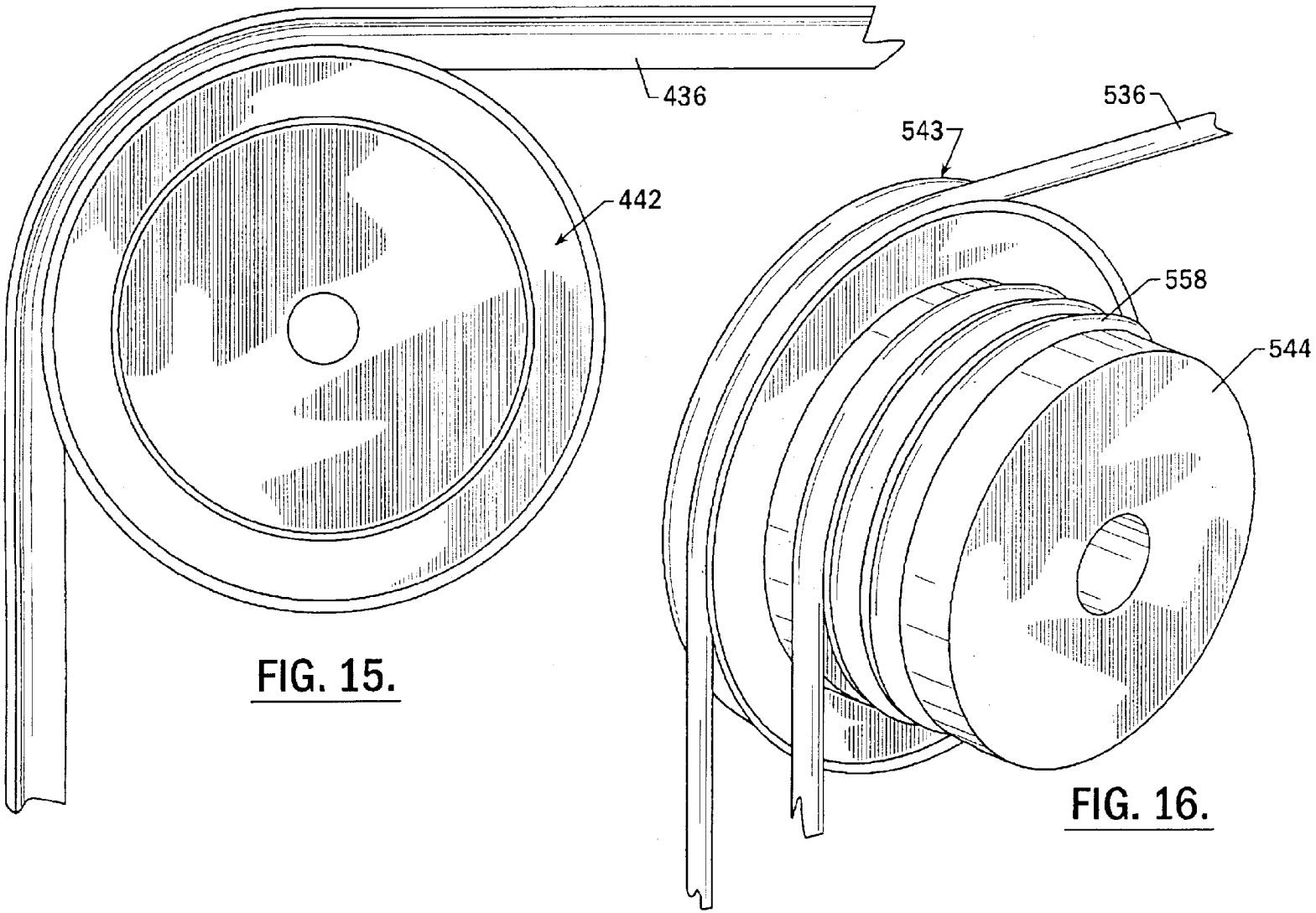
FIG. 15 is a detail view, similar to that of FIGS. 13 and 14, but illustrating another preferred link and respective roller assembly including a cable, preferably coated with a synthetic, nonsynthetic or other traction enhancing material, engaging a corresponding pulley.
FIG. 16 is a detail view, similar to that of FIGS. 13 through 15, but illustrating another alternate link and respective roller assembly including a pair of cables, preferably coated with a traction enhancing material, engaging respective grooves of a dual-groove pulley.

FIG. 13 illustrates a detail of a pulley 42 and belt 36 having complementary enmeshed teeth 52 and 50, respectively, to substantially eliminate slippage therebetween. Similarly and for the same reason, FIG. 14 illustrates a chain 336 having chain links or sections 351 engaging the teeth 352 on a sprocket 342. In FIG. 15, such purpose is accomplished by a cable 436 with a coating of any of a number of well-known traction-enhancing materials thereon. Finally, as shown in FIG. 16, the pulleys 542 and 544 can be combined into a double-groove pulley 543. It will be understood that these arrangements can be used, as desired, in all of the embodiments of the present invention where it is necessary to have positive traction between the pulley and the connecting member or belt.

Figure 17A:
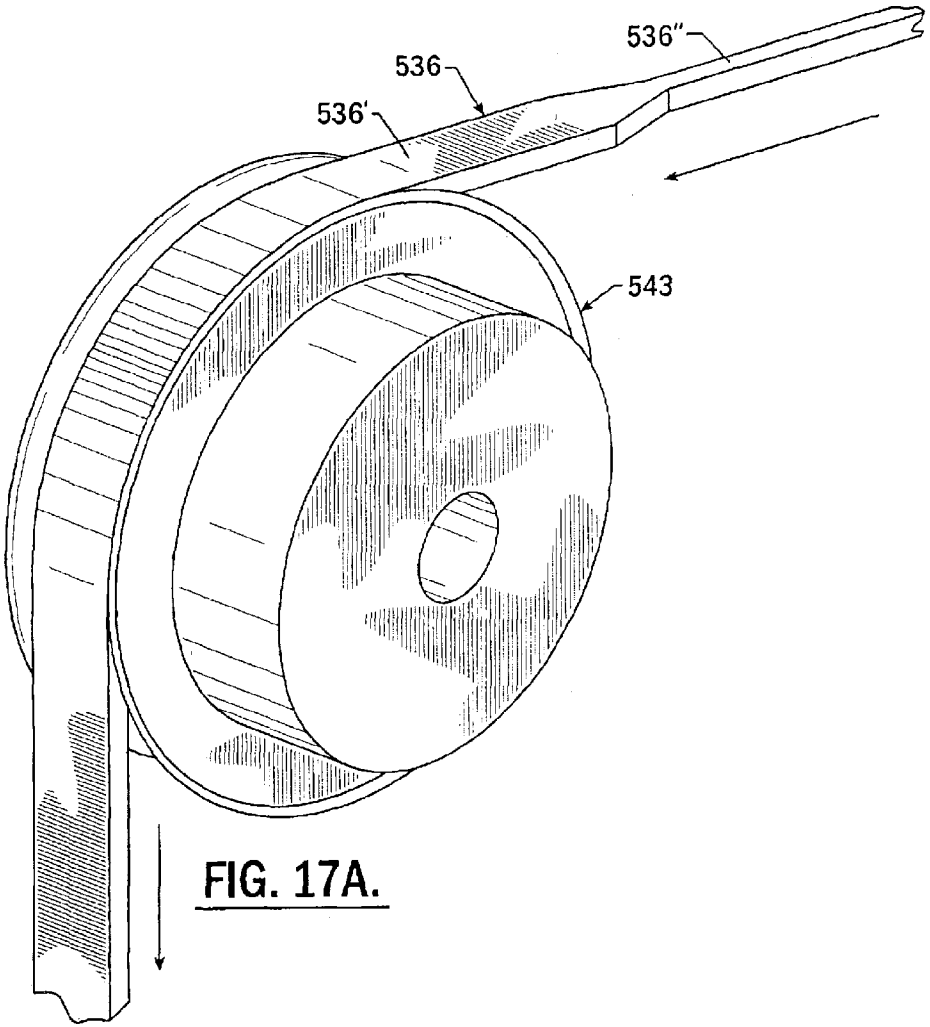
FIGS. 17A, 17B, 18A and 18B are related detail views illustrating another embodiment of the present invention which utilizes a cable or belt having sections of varying widths and a pulley coordinating therewith.
Figure 17B:
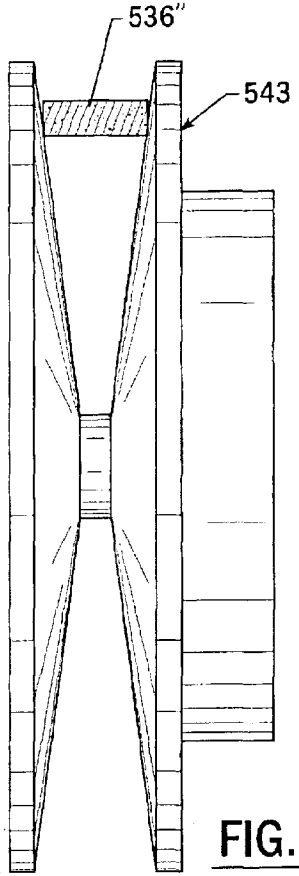
Figure 18B:
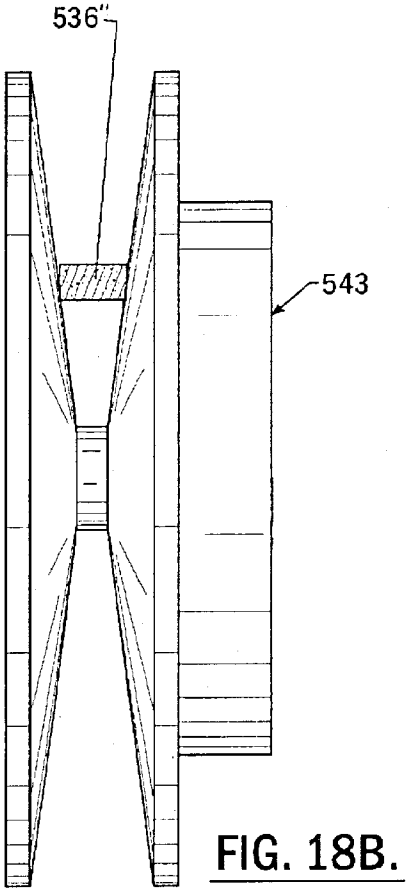

Another arrangement for controlling the movement of a counterweight is illustrated in FIGS. 17A, 17B, 18A and 18B. Looking first at FIG. 17A, the cable or connecting member 536 has a first segment 536' that is relatively wide and a second segment 536" that is relatively narrow. The connecting member 536' interconnects the sash (not shown), which is connected at the end of narrow segment 536", and the counterweight (not shown) which in connected to the end of the wider segment 536'. As best seen in FIGS. 17B and 18B, the pulley 543 is made of two halves that extend radially outwardly along gradually diverging extents so that the spacing or groove between the two halves gradually increases from the inner edge to the outermost edge of the pulley 543.

With this arrangement, as best seen in FIGS. 17A and 17B, when wider belt segment 536' in passing over the pulley 543, it will be positioned near the outer edge of the pulley 543. On the other hand when the narrow belt segment 536" is passing over the pulley 543 as seen in FIGS. 18A and 18B, it will be positioned further inwardly from the outer edge of the pulley 543.

In comparing FIGS. 17B and 18B, it will be seen that when the wider belt segment 536' is in engagement with the pulley 543, the effective radius of the pulley 543 is larger than when the narrow belt segment 536" engages the pulley 543. As a consequence, the effective weight of the counterweight acting in opposition to the weight of the sash is varied, depending on whether the narrow segment 536" or the wider segment 536' is passing through the groove of the pulley 543. More specifically, it will be apparent, looking at FIGS. 17A and 17B, that the vertical weight component of the counterweight that is acting vertically on the wider belt segment 536' is acting on a moment arm that extends outwardly from the axis of rotation of the pulley 543 to the point on the groove of the pulley 543 where the wider belt segment 536" engages such groove. By contrast, and as illustrated in FIGS. 18A and 18B, when the narrow belt segment 536" is passing through the groove of the pulley 543, the moment arm on which the weight of the counterweight acts is substantially less, which thereby lessens the effective weight of the counterweight to the extent that it is acting in opposition to the weight of the sash that is attached to the end of the narrow belt segment 536".

Figure 18A:
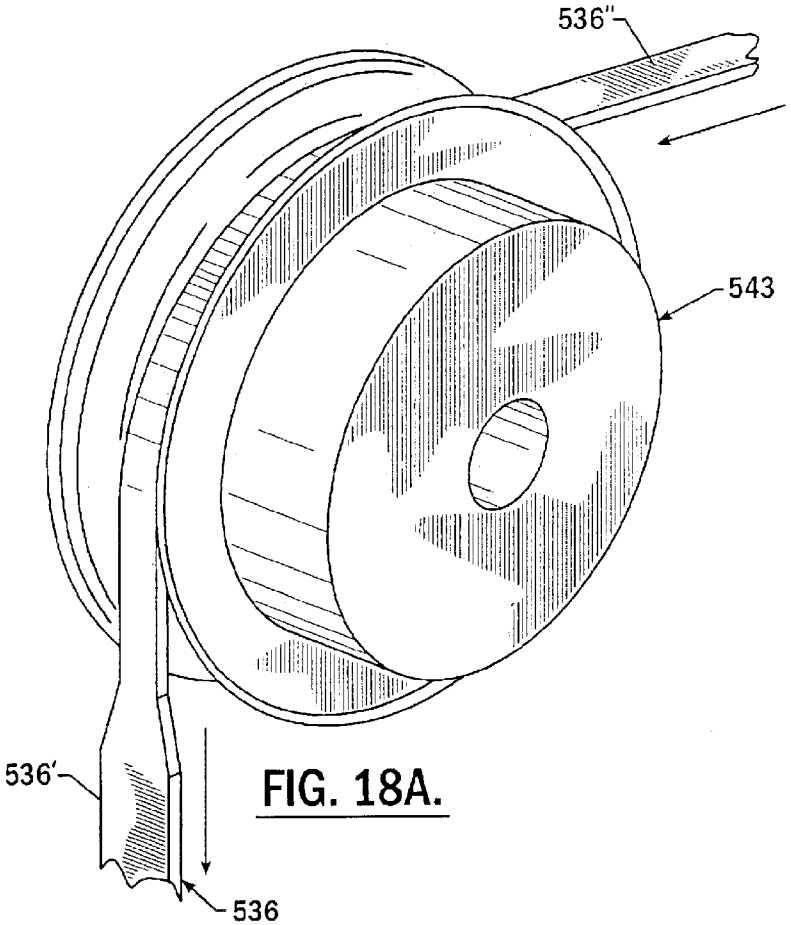

Moreover, as best seen in FIGS. 17A and 18A, the narrow belt segment 536" can be joined to the wider belt segment 536' by a gradually increasing transition segment therebetween, and this transition segment can be selected at a point along the extending length of the belt 536 so that it will reach the groove of the pulley 543 when the sash is located at its desired predetermined intermediate position between its fully opened position and its fully closed position. Therefore, as in the previous embodiments described above, if the sash is moved upwardly from its predetermined intermediate position to a more open position, the belt 536 will also move within the pulley 543 so that it will increase the effective weight of the counterweight and move the sash back to its desired predetermined intermediate position.

Figure 19:
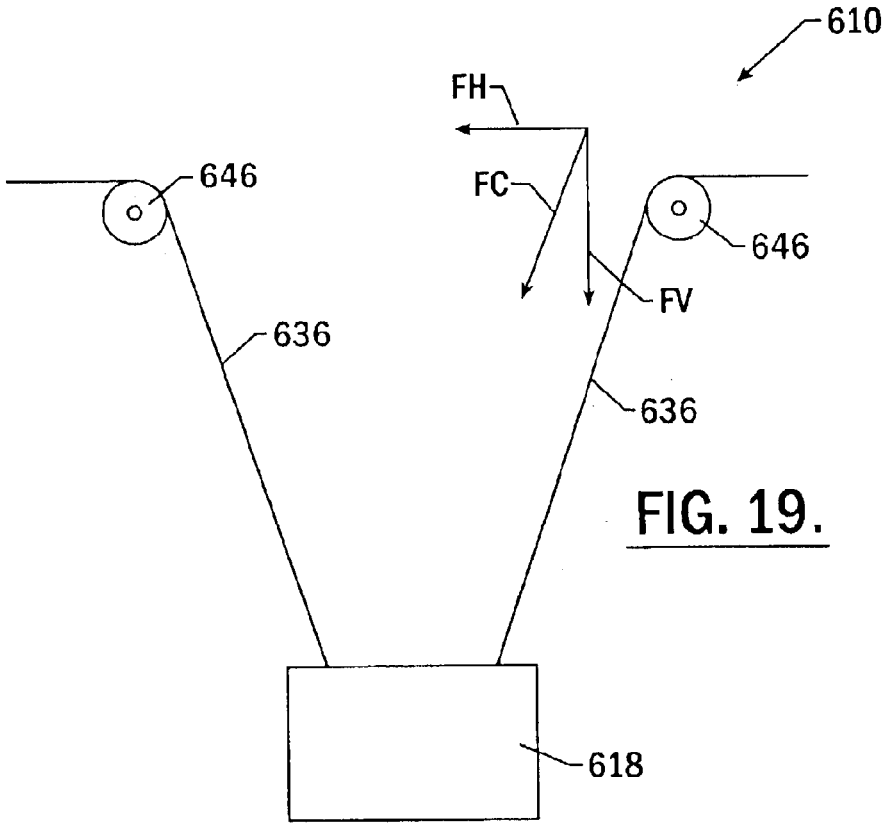
FIGS. 19 and 20 are diagrammatic illustrations of another embodiment of a sash counterbalance mechanism according to the present invention, including a pair of elongated link member and roller member assemblies supporting a sash, with the roller members spaced apart so as to vary the angle of the elongated link members and thus the effective value of the counterweight forces produced by counterweights.
Figure 20:
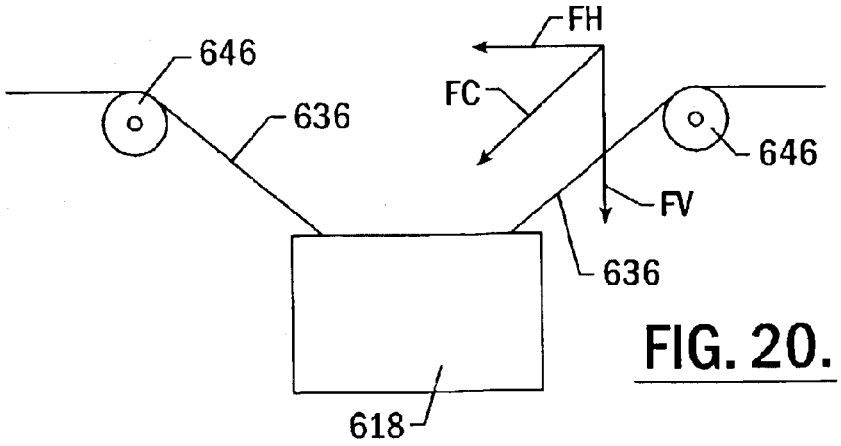

Referring now to FIGS. 19 and 20, in which "six-hundred prefixes" are used with reference numerals for elements or components corresponding to those in other drawing figures, the sash 618 is supported by a pair of cables 636, or other equivalent elongated connecting members, extending over respective pulleys 642 and interconnecting the sash 18 with the two or more counterweights (not shown in FIGS. 19 and 20). The pulleys 642 are preferably spaced apart by a distance that is greater than the spacing between the points at which the connecting members 636 are connected to the sash 618 such that the angle of the cables 636, and thus the effective value of the counterweight forces, vary depending upon the position of the sash 18.

It will be noted that in FIGS. 19 and 20 there is an inset drawing which diagrammatically illustrates the vector analysis that results from the system illustrated in FIGS. 19 and 20. Looking first at FIG. 19, this is the position at which the sash 618 would be at its fully closed position. At this position, the vector analysis indicates that the weight of the sash 618 that is acting vertically is designated as FV. Because the pulleys 646 are at the wide spacing described above, the counterweights (not shown) acting on the connecting member 636 will impose a horizontal force on the sash 618 which represented by the designation FH. The resultant vector that results from the horizontal vector FH and the vertical vector FV is represented by the designation FC.

Accordingly, when the sash 618 is at its fully closed position as illustrated diagrammatically in FIG. 19, the angle of the connecting members 636 is relatively steep and therefore the effective weight of the counterweights acting vertically in opposition to the weight of the sash 618 is relatively heavy. By properly selecting the weight of the counterweights, and the spacing and radaii of the guide pulleys 646, the effective weight of the counterweights will be such that they will maintain the sash 618 at an at-rest position when it is between its closed position and the intermediate position, or they will move the sash 618 upwardly from its fully closed position illustrated in FIG. 19. As the counterweight 618 moves upwardly, the angle of the connecting members 36 gradually approaches the horizontal, and based on the vector analysis discussed above, the effective weight of the counterweights opposing the weight of the sash 618 is gradually diminished. Again, by properly selecting the weight of the counterweights and the spacing in radaii of the guide pulley 646, it is possible to have the effective weight of the counterweight equal in weight of the sash 618 at the point where the sash 618 reaches its desired predetermined intermediate position. Moreover, it will be apparent that if the sash 618 is manually pushed upwardly from its predetermined intermediate position, the angle of the connecting member 636 will become even less acute so that the effective weight of the counterweights will be less than the weight of the sash 618, and weight of the sash 618 will therefore cause the sash 618 to return downwardly to its predetermined intermediate position.

FIGS. 21 through 24 (in which "seven-hundred prefixes" are used on reference numerals for corresponding elements) illustrate another arrangement for varying the effective value of the counterweight forces depending upon the position of the sash member 718. In this embodiment, however, the angle is varied by way of the counterweight 730 engaging an angled ramp or guide track 756 that is located beneath and in the vertical path of movement of the counterweight 730. Preferably, the guide track 756 is engaged by the counterweight 730 through a roller or caster 758 or other such friction reducing device.

Figure 21:
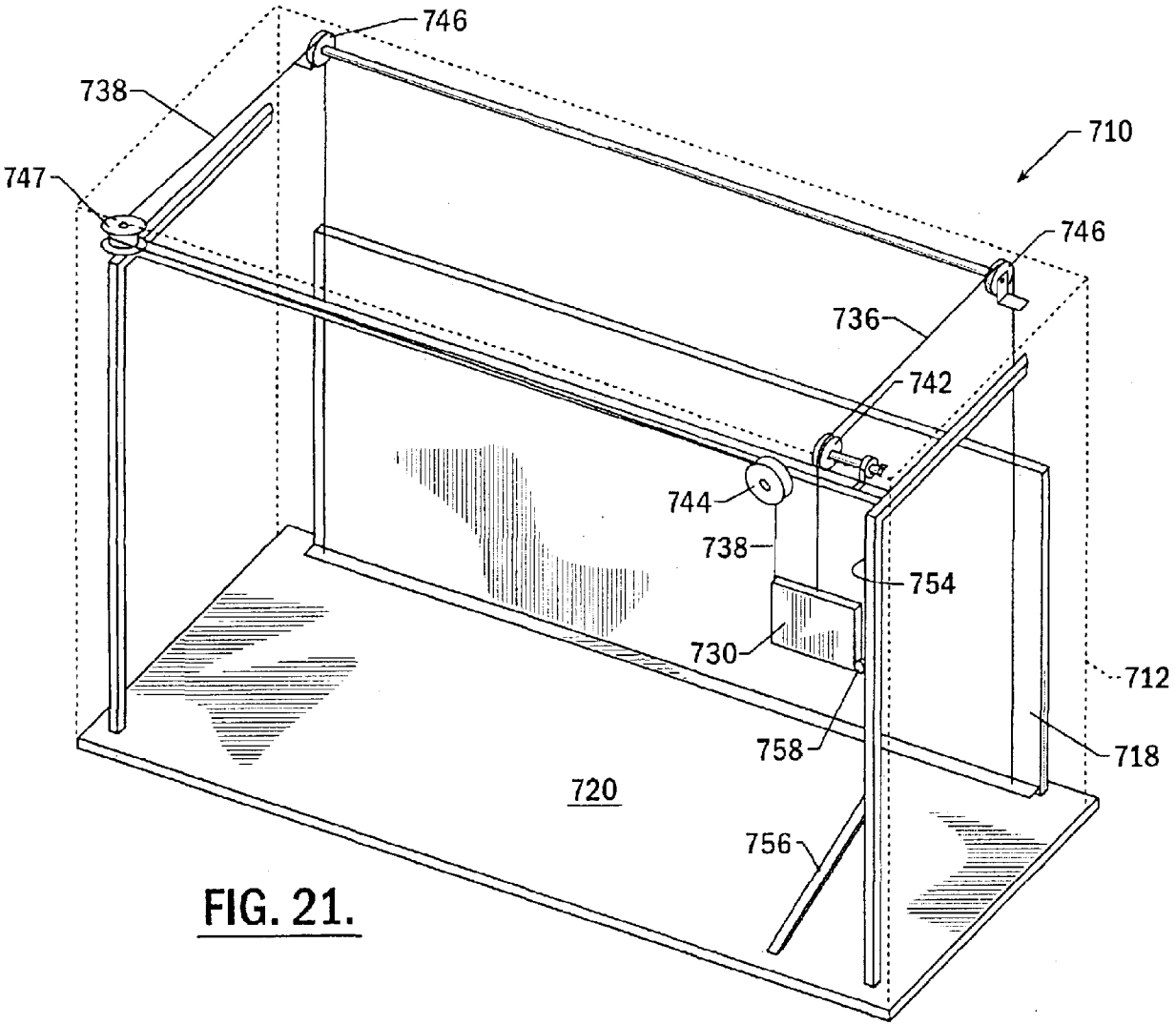
FIGS. 21 through 24 are diagrammatic illustrations of another embodiment of a sash counterbalance mechanism according to the present invention, including a pair of link member and roller member assemblies supporting a counterweight, with the counterweight engaging an angled track so as to vary the angle and thus the effective value of the counterweight forces.
Figure 22:
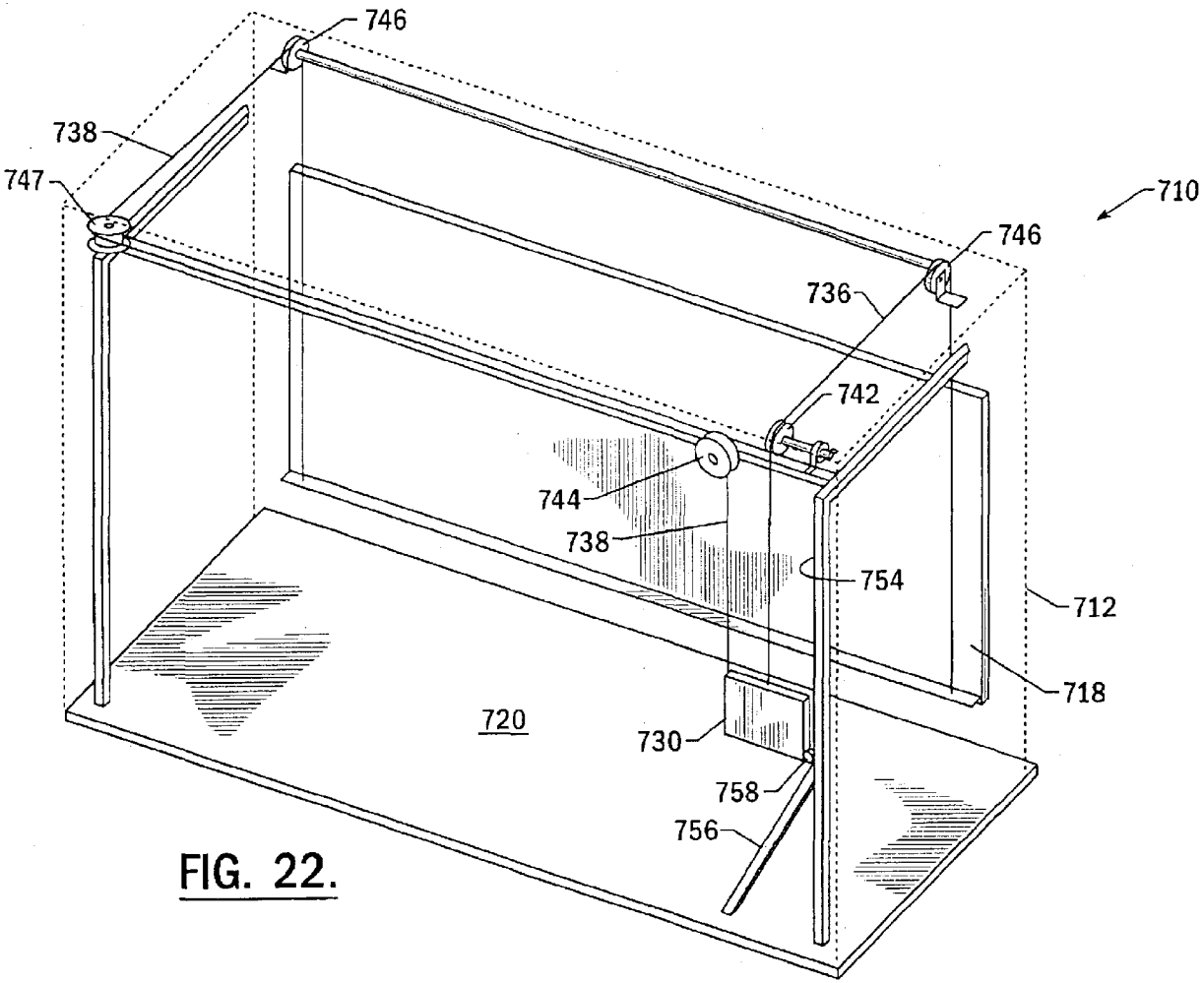
Figure 23:
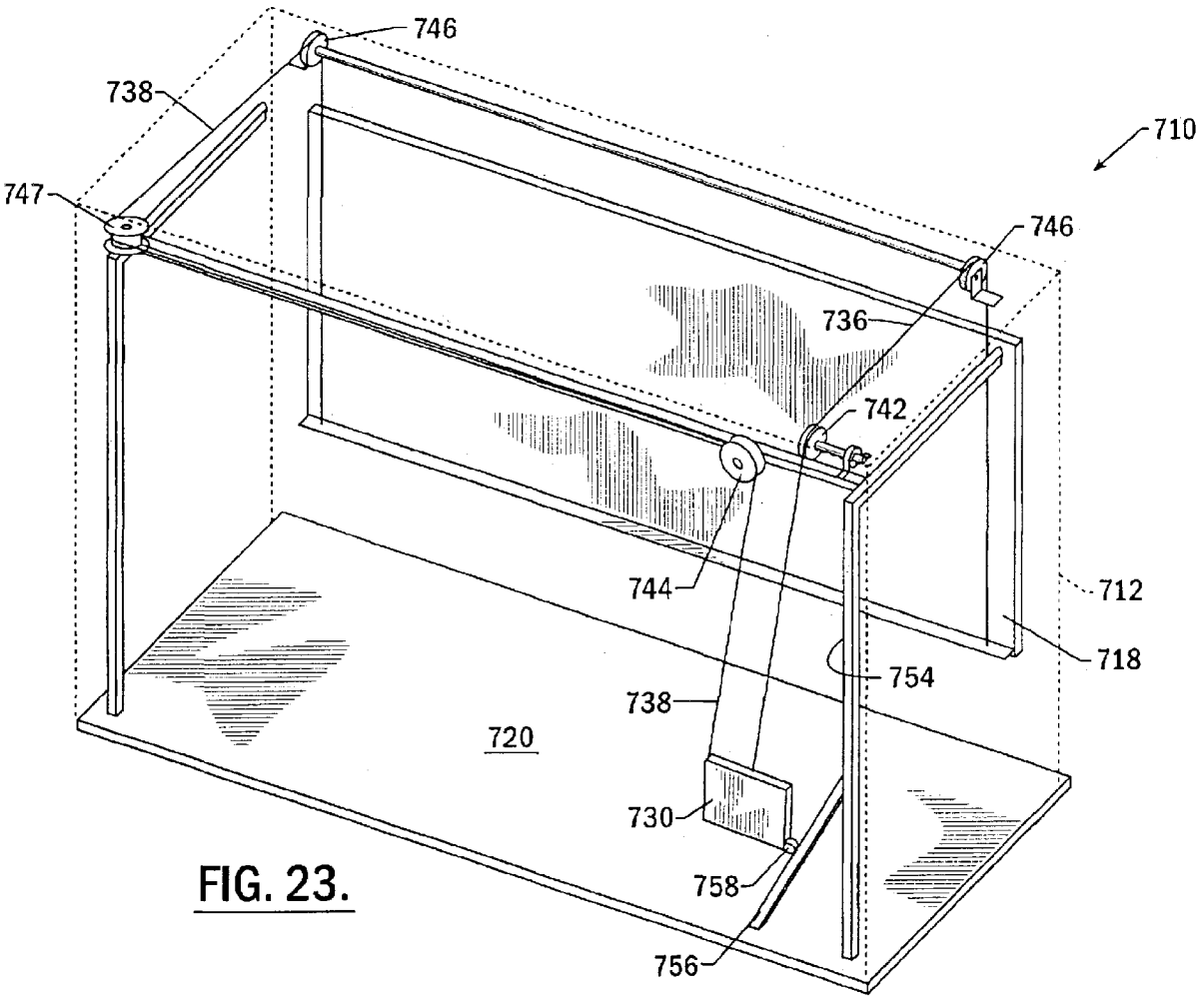
Figure 24:
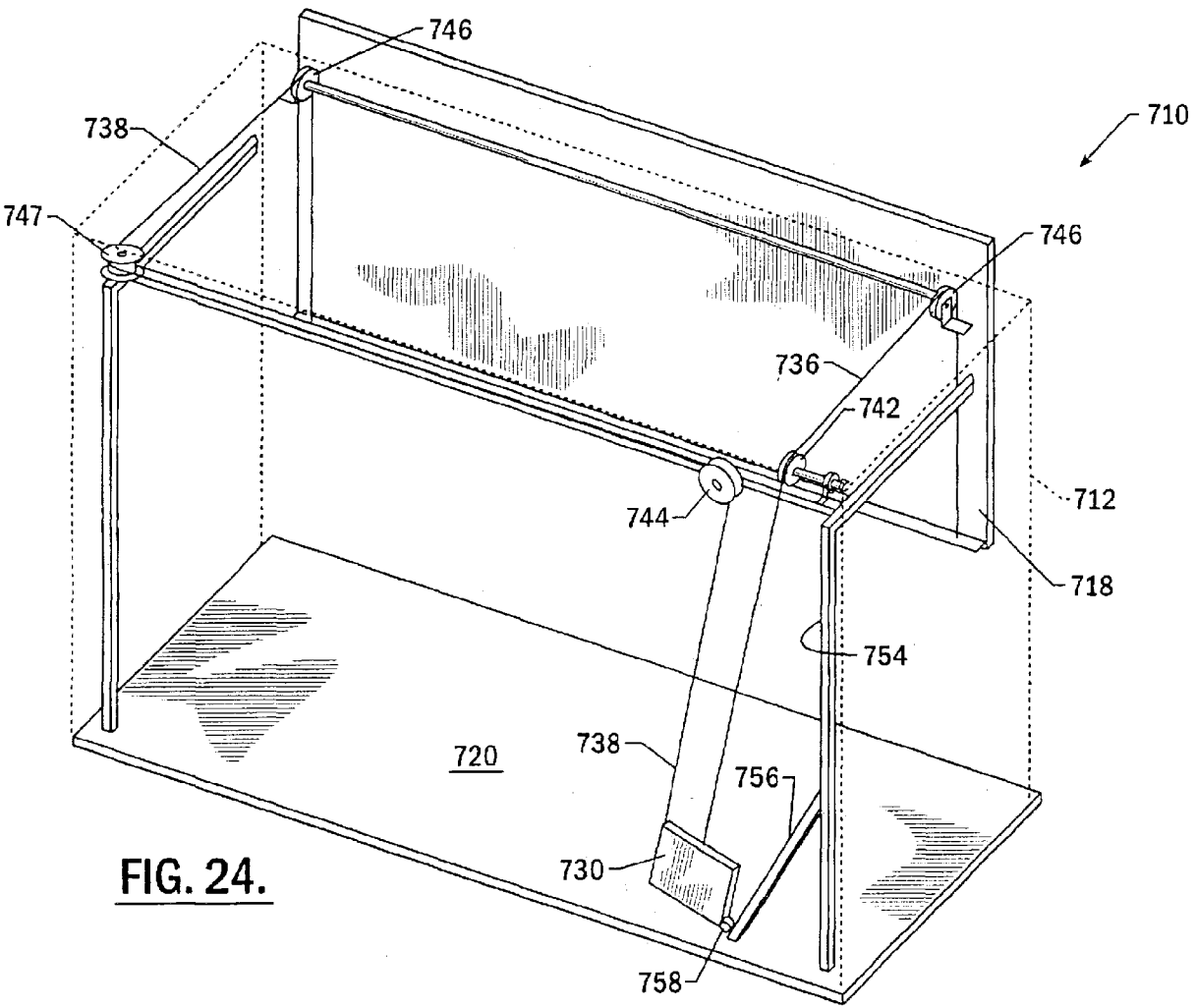
Figure 25:
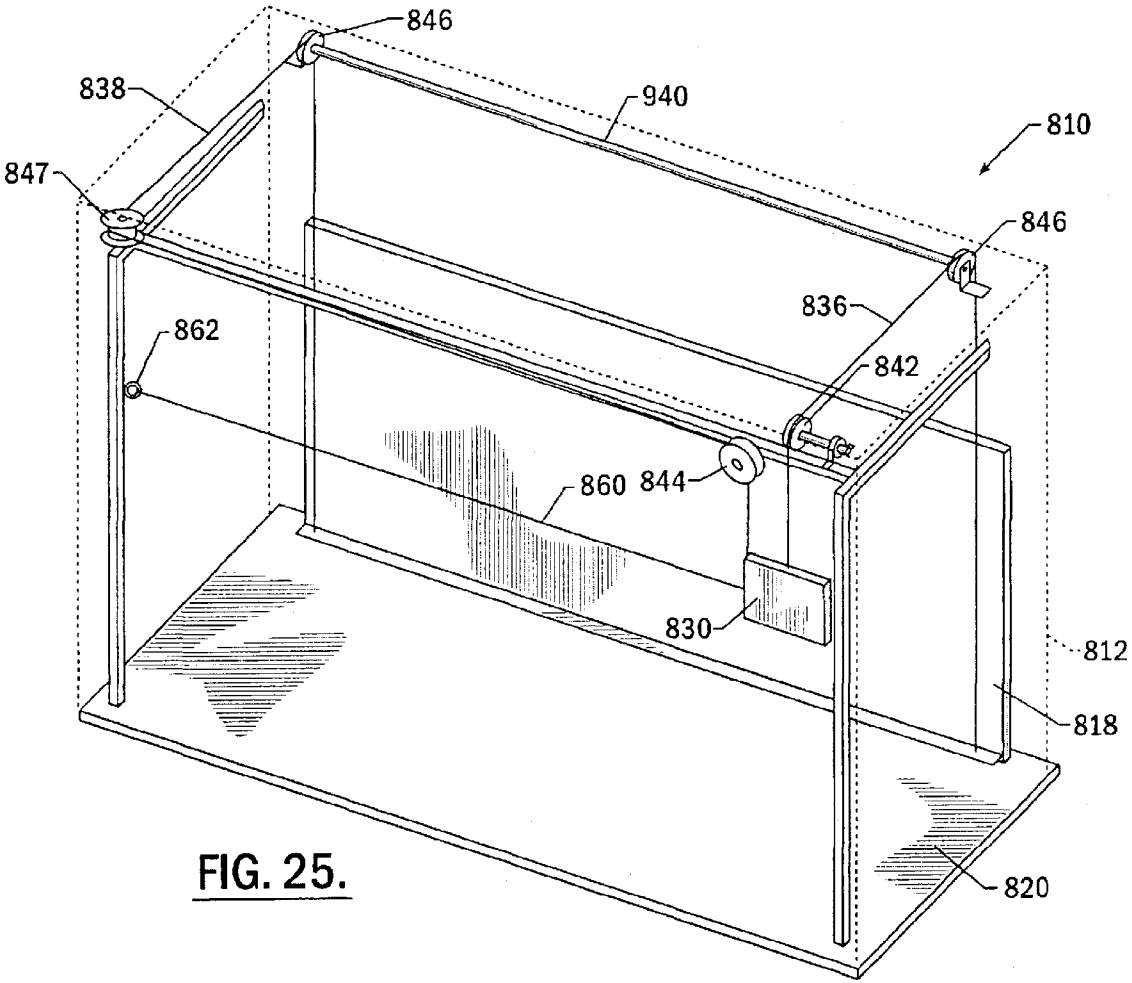
FIGS. 25 through 28 are diagrammatic illustrations of another exemplary alternate embodiment of a sash counterbalance mechanism according to the present invention which varies the effective weight of the counterweight using a connecting member extending between the counterweight and a fixed point in the enclosure.

In this embodiment of the present invention, the weight of the counterweight 730 is equal to or greater than the weight of the sash 718. Therefore, when the sash 718 is located at its fully closed position as illustrated in FIG. 21, the weight of the counterweight 730, which has only a vertical component, will either move downwardly and raise the sash 718 upwardly as the connecting member 736 pass over the guide pulleys 742, 744, 746, and 747, or maintain the sash 718 at an at-rest position. During downward movement of the counterweight 730, the roller 758 may engage a portion 754 of the frame of the fume hood apparatus 12. This downward movement of the counterweight 730 will continue until the counterweight 730 reaches the upper end of the guide tract 756, as illustrated in FIG. 22. At this point, the sash 718 is preferably at its desired predetermined intermediate position. Thereafter, if the sash 718 is moved upwardly from its predetermined intermediate position, the counterweight 730 will ride down the angled surface of the guide tract 756 which causes the counterweight 730 to move away from its normal vertical path of movement at a gradually increasing angle as illustrated in FIGS. 23 and 24. This variance in the path of movement of the counterweight 730 results in a vector analysis similar to that illustrated FIGS. 19 and 20 as discussed above. As a result, the effective weight of the counterweight 730 that acts in opposition to the weight of the sash 718 is gradually diminished as the counterweight 730 moves down the guide tract 756, and therefore the weight of the sash 718 will result in the sash 718 returning downwardly to its predetermined intermediate position when the external force raising the sash 718 is removed.

Figure 26:
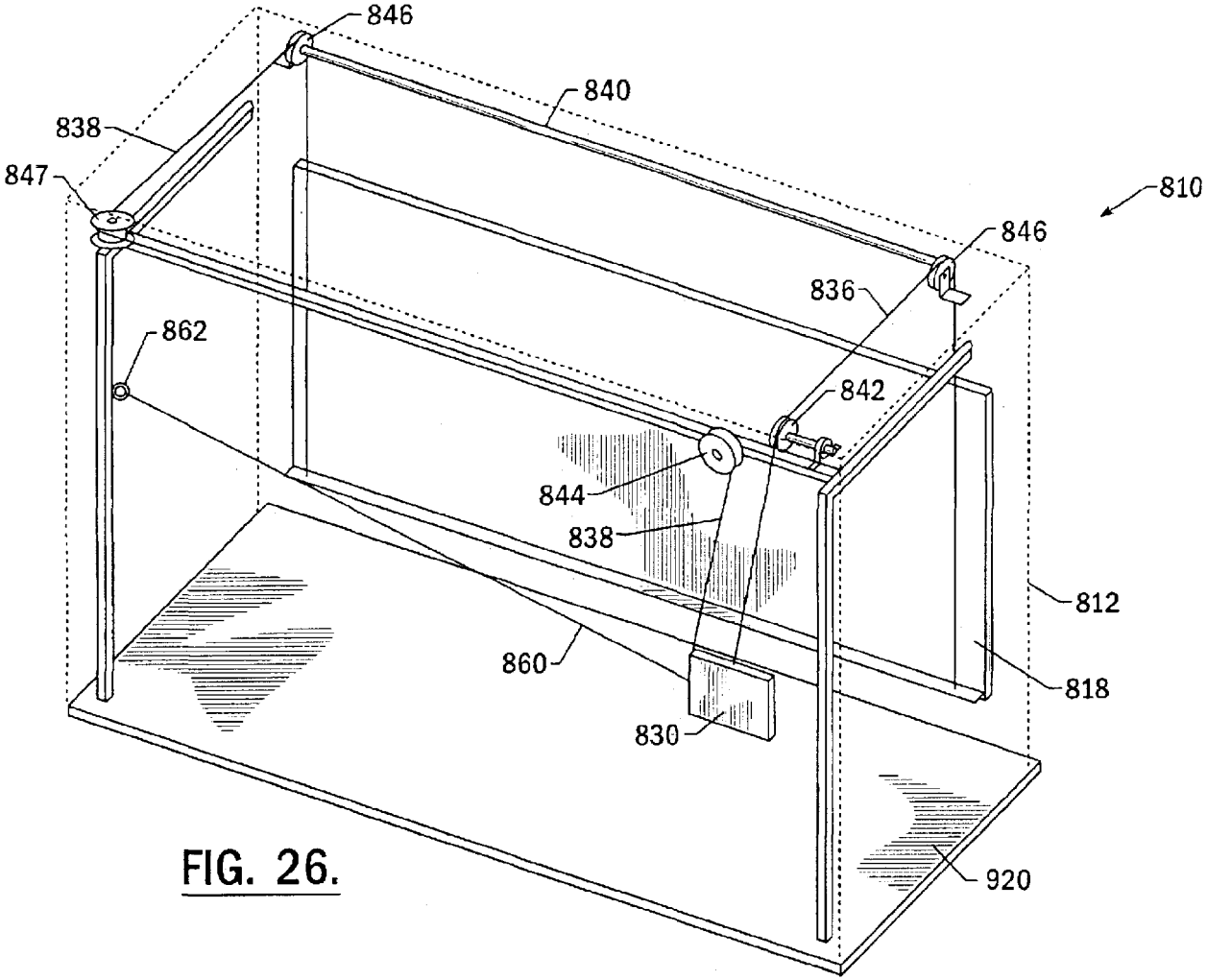
Figure 27:
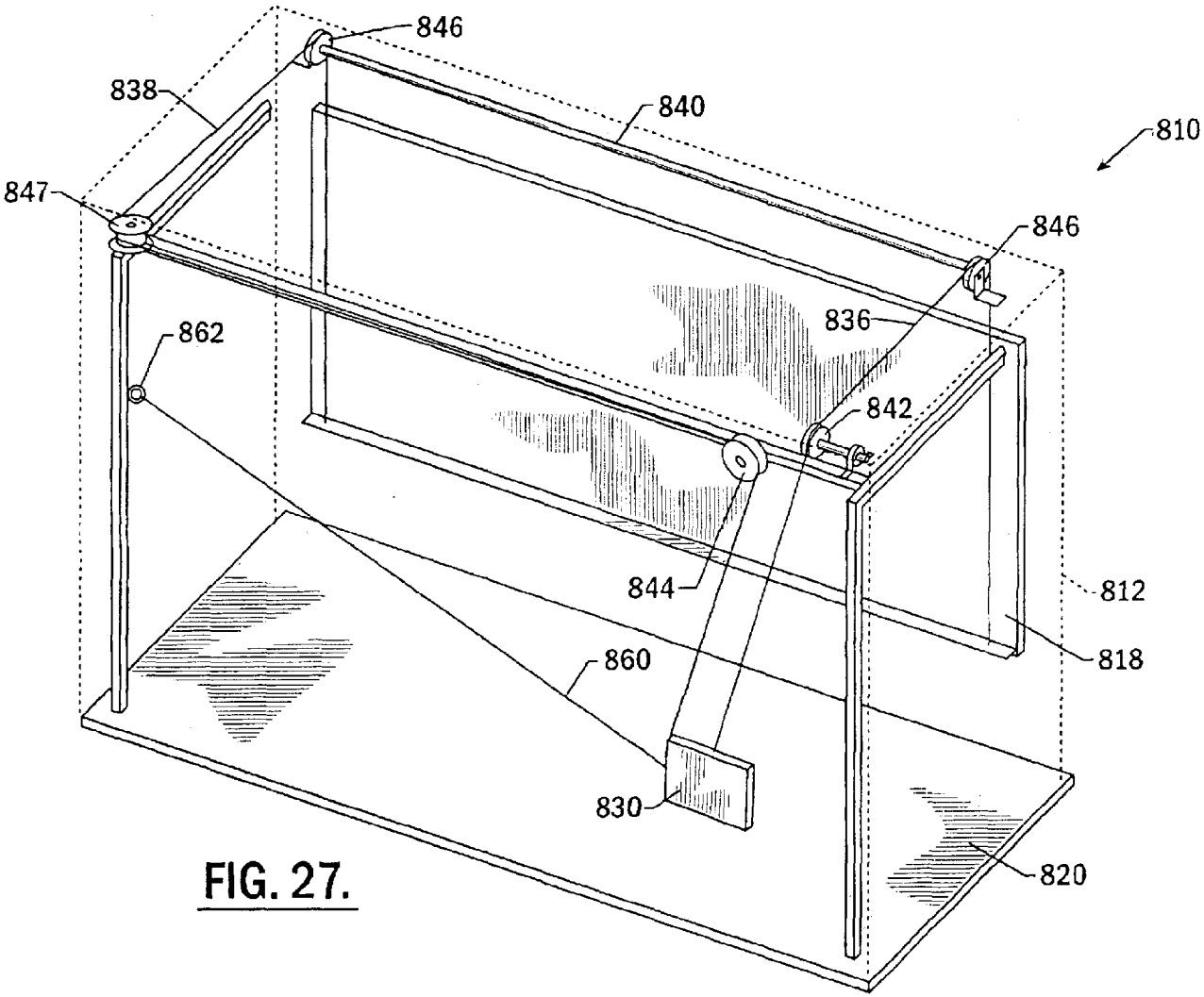
Figure 28:
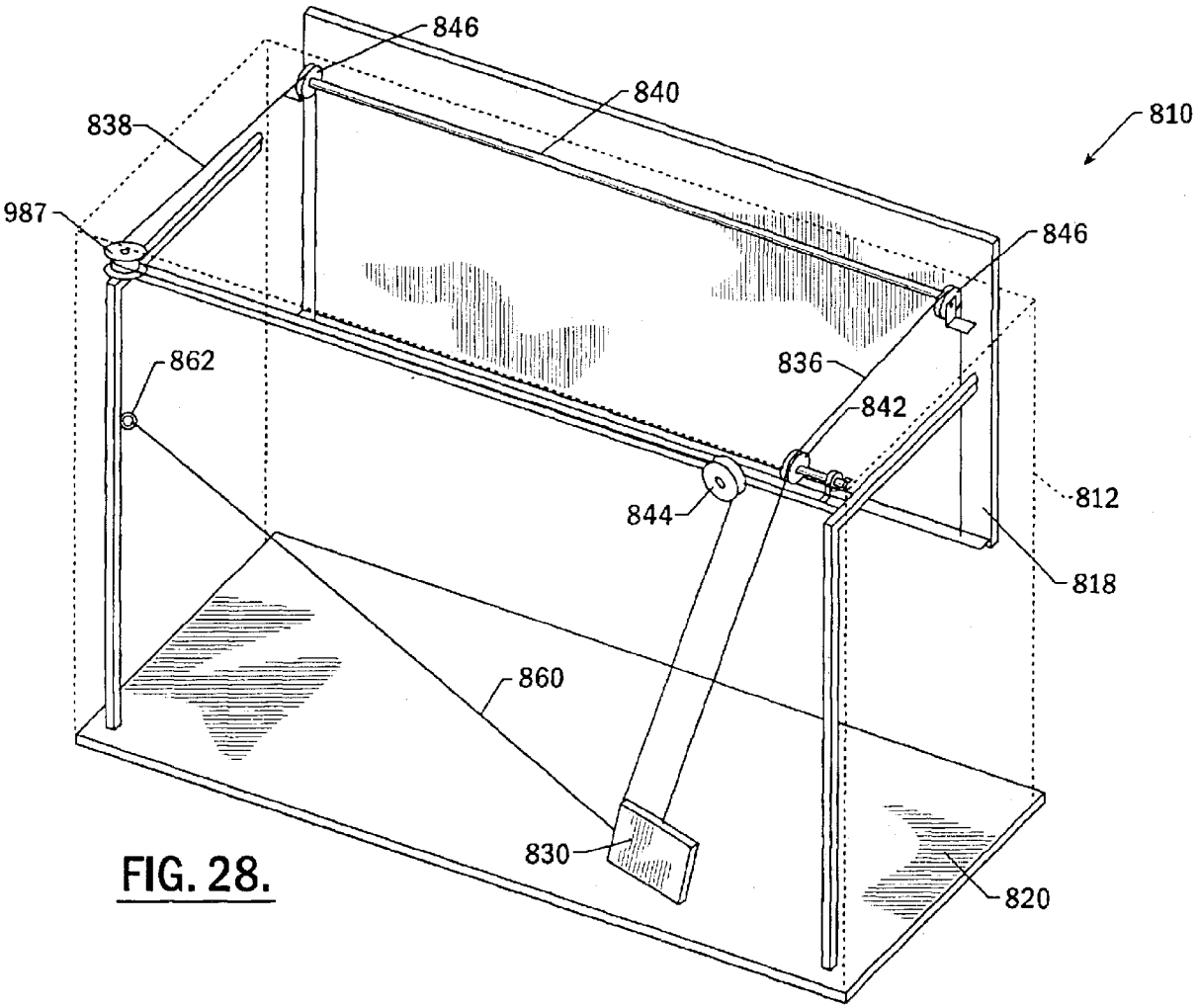

Finally, the embodiment illustrated in FIGS. 25 through 28 (in which "800 prefixes" are used on referenced numerals for corresponding elements), the movement on the counterweight 830, and its effective weight, is almost the same as that described above in connection with the embodiments illustrated in FIGS. 21 through 24. However, in this embodiment, the counterweight 830 is selectively moved at an angle to its normal vertical path using a connecting member 838 member connecting the sash 818 with the counterweight 830, and using a guide line 860 that is attached to the counterweight 830 and extends with a fixed length to a connection with an eyelet 862 or other fixed element of the fume hood apparatus 12. The location of the eyelet 862 and the length of the guideline 860 are selected so that when the sash 818 moves from its closed position illustrated in FIG. 25 to its predetermined intermediate position as illustrated in FIG. 26, the counterweight 830 moves in a path slightly offset from a vertical path.

Because of the length of guideline 860 and the large ARC of movement of the counterweight 830, the effective weight of the counterweight can be selected to cause such effective weight to offset the weight of the sash 818 when it reaches the position illustrated in FIG. 26. Thereafter, any upward movement of the sash 818 will result in the counterweight moving angularly away from its vertical path to a greater extent all in the same manner as that described in greater detail above.

The foregoing discussion discloses and describes merely exemplary embodiments of the present invention for purposes of illustration. One skilled in the art will readily recognize from such discussion, and from the accompanying drawings and claims, that various changes, modifications, and variations can be made therein without departing from the substance, spirit or scope of the present invention, as defined in the following claims.

What is claimed is:

1. In an enclosure having an interior chamber, an access opening in said enclosure providing access to said interior chamber, a closure member movable between closed and fully open positions in said access opening for selectively allowing and restricting said access to said interior chamber, the improvement comprising:

at least one primary counterweight, a primary connecting member interconnecting said primary counterweight and said closure member for movement therewith, and a primary roller member mounted for rotation about an axis of rotation, said primary roller member being engaged by said primary connecting member intermediate said primary counterweight and said closure member for rotation by said primary connecting member in response to movement of said closure member;

at least one secondary counterweight, a secondary roller member arranged to rotate with said first roller member, and a secondary connecting member interconnecting said secondary roller member and said secondary counterweight, said secondary member movably winding and unwinding on said secondary roller member in response to movement of said closure member;

said closure member being movable to at least one predetermined intermediate position between said closed and fully open positions, with said secondary connecting member winding and unwinding from said secondary roller member in a first moment-producing direction on said secondary roller member when said closure member is moved between said closed position and said intermediate position, and with said secondary connecting member winding and unwinding on said secondary roller member in a second moment-producing direction on said secondary roller member when said closure member is moved between said intermediate position and said fully open position, said second moment-producing direction being opposite to said first moment producing direction.

2. The improvement according to claim 1, wherein said primary and secondary counterweights maintain said closure member in a substantially stationary at-rest condition when said closure member is located at said predetermined intermediate position between its fully open and fully closed positions.

3. The improvement according to claim 1, wherein said closure member is a sash member movable generally vertically between said fully closed and open positions.

4. The improvement according to claim 1, wherein said primary connecting member is a toothed belt, and wherein the outer periphery of said primary roller member has teeth thereon enmeshingly engaging said toothed belt.

5. The improvement according to claim 1, wherein said secondary connecting member is a cable having one end fixedly interconnected to said secondary roller member.

6. The improvement according to claim 1, wherein said primary connecting member is a cable having a traction-surface thereon for positively engaging said primary roller member.

7. The improvement according to claim 6, wherein said secondary connecting member is a cable having one end fixedly interconnected to said secondary roller member.

8. The improvement according to claim 1, wherein said primary connecting member is a chain, and wherein said primary roller member is a sprocket enmeshingly engaging said chain.

9. The improvement according to claim 1, wherein there are two primary counterweights and wherein there are two primary connecting members for connecting said two primary counterweights to said closure member, and wherein two primary rollers are provided for engagement with said two primary connecting members, respectively, with said two primary rollers being connected to rotate together about an axis of rotation.

10. The improvement according to claim 9, wherein said two primary rollers and said secondary roller are connected together by a shaft for rotation about the axis of rotation of said shaft.

11. The improvement according to claim 10, wherein said secondary counterweight is attached to said shaft at a location intermediate said primary counterweights.

12. The improvement according to claim 1, wherein there are two primary connecting members and two corresponding primary rollers, and wherein each of said two primary connecting members is connected to said primary counterweight and to said closure member and is in engagement with one of said primary rollers.

13. The improvement according to claim 12, wherein said two primary rollers and said secondary roller are connected together by a shaft for rotation about the axis of rotation of said shaft.

14. The improvement according to claim 1, wherein said primary roller and said secondary roller are joined integrally as a double-grooved pulley that is mounted for rotation about an axis of rotation.

15. The improvement according to claim 14, wherein said double-grooved pulley is mounted for rotation on a shaft extending across said interior chamber.

16. The improvement according to claim 1, wherein the outer peripheries of primary and secondary roller members have substantially the same diameter.

17. The improvement according to claim 1, wherein the outer peripheries of primary and secondary roller members have different diameters.

18. The improvement according to claim 1, wherein said primary and secondary roller members are pulleys.

19. In an enclosure having an interior chamber, an access opening in said enclosure providing access to said interior chamber, a closure member movable between closed and fully open positions in said access opening for selectively allowing and restricting said access to said interior chamber, the improvement comprising:

at least one primary counterweight, a primary connecting member interconnecting said primary counterweight and said closure member for movement therewith, and a primary roller member mounted for rotation about an axis of rotation, said primary roller member being engaged by said primary elongated link member intermediate said primary counterweight and said closure member for rotation by said primary connecting member in response to movement of said closure member;

a pair of secondary counterweights, a respective pair of secondary roller members rotatably fixed relative to said primary roller member for rotation therewith, and a pair of respective secondary connecting members each having an end portion fixedly interconnected with a respective one of said secondary roller members and an opposite end portion fixedly interconnected with a respective one of said secondary counterweights, said secondary connecting members movably winding and unwinding on said secondary roller members in response to movement of said closure member;

said closure member being movable to first and second predetermined intermediate positions between said fully closed and fully open positions, with each of said secondary connecting members winding and unwinding in a first moment-producing direction on one of said respective secondary roller members, respectively, when said closure member is moved between said closed position and said first intermediate position, and with one of said secondary connecting members winding and unwinding in said first moment-producing direction on one of said respective secondary roller members and the other of said secondary connecting members winding and unwinding in a second opposite moment-producing direction on the other of said respective secondary roller members when said closure member is moved between said first intermediate position and said second intermediate position, and with both of said secondary connecting members winding and unwinding in said second moment-producing direction on said respective secondary roller members when said closure member is moved between said second intermediate position and said fully open position.

20. The improvement according to claim 19, wherein said secondary counterweights produce respective opening moments assisting said opening movement of said closure member when said respective secondary connecting members wrap and unwrap on said respective secondary roller members in said first moment-produce direction, and produces second respective closing moments assisting said closing movement of said closure member when said respective secondary connecting members wrap and unwrap on said respective secondary roller members in said second opposite moment-producing direction.

21. The improvement according to claim 19, wherein said primary and secondary counterweights maintain said closure member in a substantial stationary at-rest condition when said closure member is at a predetermined intermediate position between said fully closed position and said fully open position.

22. The improvement according to claim 19, wherein said closure member is a sash member movable generally vertically between said fully closed and open positions.

23. The improvement according to claim 19, wherein said primary connecting member is a toothed belt, and wherein said primary roller member has teeth thereon enmeshingly engaging said toothed belt.

24. The improvement according to claim 19, wherein said secondary connecting members are cables, each having one end fixedly interconnected to said one of said respective secondary roller members.

25. The improvement according to claim 19, wherein said primary connecting member is a cable having a traction-surface thereon for positively engaging said of said primary roller member.

26. The improvement according to claim 24, wherein said second connecting members are cables, each having one end fixedly interconnected to said one of said respective secondary roller members.

27. The improvement according to claim 19, wherein said primary connecting member is a chain, and, wherein said primary roller member is a sprocket enmeshingly engaging said chain.

28. The improvement according to claim 19, wherein said primary roller member and said secondary roller members have substantially the same diameter.

29. The improvement according to claim 19, wherein said primary roller member has a different diameter than the diameters of said secondary roller members.

30. The improvement according to claim 28, wherein said secondary roller members have diameters that are different from the diameter of said primary roller member.

31. The improvement according to claim 19, wherein said primary and secondary roller members are pulleys.

32. In a fume hood enclosure having an interior chamber, an access opening in said enclosure providing access to said interior chamber, a sash member movable generally vertically between closed and fully open positions in said access opening for selectively allowing and restricting said access to said interior chamber, the improvement comprising:

at least one primary counterweight, a primary connecting member interconnecting said primary counterweight and said sash for movement therewith, a rotatable axle, and a first pulley rotatably fixed relative to said rotatable axle for rotation therewith, said first pulley being movably engaged by said primary connecting member between said primary counterweight and said sash for rotation in response to movement of said sash;

a secondary counterweight, a second pulley rotatably fixed relative to said rotatable axle for rotation therewith, and a secondary connecting member having an end portion fixedly interconnected with said second pulley and an opposite end portion fixedly interconnected with said secondary counterweight, said secondary connecting member movably winding and unwinding on said second pulley in response to movement of said sash;

said sash further being movable to at least one predetermined intermediate position between said closed and fully open positions, said secondary connecting member wrapping and unwrapping in a first moment-producing direction on said second pulley when said sash is moved between said closed position and said intermediate position, said secondary connecting member movably winding and unwinding in a second opposite moment-producing direction on said second pulley when said sash is moved between said intermediate position and said fully open position, and said secondary counterweight producing an opening moment assisting said opening movement of said sash when said secondary connecting member wraps and unwraps on said second pulley in said first moment-producing direction and producing a closing moment assisting said closing movement of said sash when said secondary connecting member wraps and unwraps on said second pulley in said second opposite moment-producing direction.

33. The improvement according to claim 32, wherein said primary and secondary counterweights maintain said sash in a substantial stationary at-rest condition when said sash is at a predetermined intermediate position between said fully closed and fully open positions.

34. In an enclosure having an interior chamber, an access opening in said enclosure providing access to said interior chamber, a closure member movable between closed and fully open positions in said access opening for selectively allowing and restricting said access to said interior chamber, the improvement comprising:

at least one counterweight;

at least two connecting members, each interconnecting said counterweight and said closure member; and at least two guide members disposed between said counterweight and said closure member with said two connecting members extending over said two guide members, respectively, so that said counterweight and said closure member move together in opposite vertical directions, said two guide members being positioned so that the portions of said two connecting members extending between said support members and said closure member extend at an angle to vertical that varies as said closure member moves between said closed and fully open position to thereby vary the effective vertical counterweight forces exerted on said closure member by said counterweight.

35. The improvement according to claim 34, wherein said two guide members are rollers spaced from one another, and wherein said closure member moves in a vertical path of movement that is between said rollers.

36. The improvement according to claim 34, wherein said effective vertical counterweight force is equal to the weight of said closure member when said closure member is moved to a predetermined intermediate position between said fully open and fully closed position of said closure member.

37. In an enclosure having an interior chamber, an access opening in said enclosure providing access to said interior chamber, a closure member movable between closed and fully open positions in said access opening for selectively allowing and restricting said access to said interior chamber, the improvement comprising:

a counterweight;

a connecting member connecting said counterweight to said closure member;

at least one guide member disposed between said counterweight and said closure member with said connecting member extending over said guide member so that said counterweight and said closure member can move together in opposite vertical directions; and a track member disposed in the path of said vertical movement of said counterweight and extending at an angle to the vertical path of movement of said counterweight whereby said counterweight will engage said track member during a predetermined portion of its downward movement and will be moved at an angle away from said vertical path of movement to thereby vary the effective vertical counterweight force exerted on said closure member by said counterweight.

38. The improvement according to claim 37, wherein a rotatable engagement member is mounted on said counterweight and positioned to rotatably engage said track member.

39. The improvement according to claim 37, wherein the portion of said connecting member extending between said guide member and said counterweight extends in a vertical direction during movement of said counterweight when it is not in engagement with said track member and will extend at an angle to vertical when said counterweight is in engagement with said track member.

40. The improvement according to claim 39, wherein said angle of said connecting member portion increases as said counterweight moves downwardly along said track member.

41. The improvement according to claim 37, wherein there are two said guide members, wherein there are two said connecting members, and wherein said guide members are located vertically above said counterweight so that the portions of said connecting members extending between said guide members and said counterweight will extend in a vertical direction during movement of said counterweight when it is not in engagement with said track member and will extend at an angle to vertical when said counterweight is in engagement with said track member, said angle increasing as said counterweight moves downwardly along said track member.

42. In an enclosure having an interior chamber, an access opening in said enclosure providing access to said interior chamber, a closure member movable between closed and fully open positions in said access opening for selectively allowing and restricting said access to said interior chamber, the improvement comprising:

a counterweight;

a first connecting member connecting said counterweight to said closure member;

at least one guide member disposed between said counterweight and said closure member with said first connecting member extending over said guide member so that said counterweight and said closure member can move together in opposite vertical directions; and a second connecting member extending between said counterweight and a fixed element in said enclosure, said second connecting member having a fixed length and said fixed element being located to cause said second connecting member to move said counterweight at an angle away from said vertical direction of movement to thereby vary the effective vertical counterweight force exerted on said closure member by said counterweight.

43. The improvement defined in claim 42, wherein said effective vertical counterweight force is varied to result in such force being less than the weight of said closure member when said closure member moves between said fully open position and a predetermined intermediate position between said fully closed and fully open positions, and to result in the such force being substantially equal to said weight of said closure member when it is at said predetermined intermediate position.

44. A method of controlling the movement of a closure member disposed in an access opening of an enclosure to cause said closure member to automatically return to a predetermined position between the fully opened and fully closed positions of said closure member when is it moved away from said predetermined intermediate position, said method comprising the steps of:

(a) providing a primary counterweight that moves with said closure member and acts oppositely to the weight of said closure member during movement thereof between said open and closed positions; and (b) providing a secondary weight which moves with said closure member and which acts oppositely to the weight of said closure member during movement thereof between said fully closed position and said predetermined intermediate position thereof, and which acts oppositely to the weight of said primary counterweight during movement thereof between said fully closed position and said predetermined intermediate position thereof, whereby said secondary weight acts to assist in moving said closure member toward said predetermined intermediate position thereof whenever it is moved away from said predetermined intermediate position toward its fully opened position.

45. A method as defined in claim 44, wherein said method includes the steps of connecting said closure member to said primary counterweight with a primary connecting member, connecting said secondary weight to said secondary counterweight with a secondary connecting member, and utilizing said primary and secondary connecting members to rotate a rotatable member.

46. A method as defined in claim 45, wherein said step of utilizing said connecting members to rotate a rotatable member includes causing said secondary connecting member to be wound about said rotatable member in one direction of rotation when the weight of said secondary counterweight is acting oppositely to the weight of said closure member, and causing said secondary connecting member to be wound about said rotatable member in the opposite direction of rotation when the weight of said secondary counterweight is acting oppositely to the weight of said primary counterweight.

47. A method of controlling the movement of a closure member disposed in an access opening of an enclosure when is it moved between its fully opened position and its fully closed position, said method comprising the steps of:

(a) providing a connecting member having a first predetermined width along a first segment of its extending length and having a second predetermined width along a second segment of its extending length which is less than said first predetermined width;

(b) providing a rotatable pulley that is formed with a groove having a gradually increasing spacing between the sides of the groove along its radially outward extent;

(c) connecting said connecting member to said closure member and to a counterweight with said first and second segments of said connecting members being located intermediate said closure member and said counterweight; and (d) positioning said connecting member in said groove of said pulley so that during a first portion of said movement of said closure member between its fully opened and fully closed positions said first segment of said connecting member is within the groove of said pulley, and so that during a second portion of said movement of said closure member between its fully opened and fully closed positions said second segment of said connecting member is within the groove of said pulley, whereby the effective weight of said counterweight opposing the weight of said closure member can be varied.

48. A method of controlling the movement of a closure member as defined in claim 47, wherein said first segment of said connecting member is positioned in said groove of said pulley when said closure member is located between its fully closed position and a predetermined intermediate position between said fully open and fully closed positions, and wherein said second segment of said connecting member is located in the groove of said pulley when said closure member is located between said fully open position and said predetermined intermediate position.

49. A method of controlling the movement of a closure member as defined in claim 48, wherein said connecting member is formed with a transition portion connecting said first and said second segments thereof, and wherein said transition portion of said connecting member is positioned in said groove of said pulley when said closure member is located at said predetermined intermediate position.

50. A method of controlling the movement of a closure member disposed in an access opening of an enclosure when is it moved between its fully opened position and its fully closed position, said method comprising the steps of:

(a) connecting said closure member to at least one counterweight using two connecting members, respectively, with said two connecting members connected to said closure member at two separate points having a first spacing therebetween;

(b) positioning two guide members above said closure member with a generally horizontal second spacing therebetween that is greater than said first spacing; and (c) positioning said two connecting members to pass over said two guide members, respectively, so that said guide members are located intermediate said closure members and said counterweight and so that the portion of said connecting members extending between said closure member and said two guide members extend at an angle that is offset from vertical and that changes as said closure member moves between said fully opened and closed positions thereof to vary the effective weight of said counterweight acting on said closure member.

51. A method of controlling the movement of a closure member disposed in an access opening of an enclosure as defined in claim 50, wherein said closure member is caused to automatically return to a predetermined intermediate position between the fully opened and fully closed positions of said closure member by said counterweight when is it moved away from said predetermined intermediate position toward its fully opened position.

52. A method of controlling the movement of a closure member disposed in an access opening of an enclosure when is it moved between its fully opened position and its fully closed position, said method comprising the steps of:

(a) connecting said closure member to a counterweight using a first connecting member that is connected to said counterweight at a first point along its widthwise extent and using a second connecting member that is connected to said counterweight at a second point spaced generally widthwise from said first point;

(b) positioning two guide members intermediate said closure member and said counterweight for receiving said first and second connecting members, respectively, and guiding them to normally move said counterweight in a vertical direction of movement opposite to the direction of movement of said closure member;

(c) disposing a ramp member in the path of said vertical movement of said counterweight that extends at an angle to vertical; and (d) causing said counterweight to engage said ramp member during a portion of said vertical movement thereof and then move in an angled direction relative to its normal vertical movement to thereby vary the effective weight of the counterweight acting oppositely to the weight of said closure member.

53. A method of controlling the movement of a closure member disposed in an access opening of an enclosure as defined in claim 52, wherein said closure member will automatically return to a predetermined intermediate position between the fully opened and fully closed positions of said closure member by said counterweight when is it moved away from said predetermined intermediate position toward its fully opened position, and wherein said counterweight engages said ramp member when said closure member moves away from its predetermined intermediate position toward its fully opened position.

54. A method of controlling the movement of a closure member disposed in an access opening of an enclosure when is it moved between its fully opened position and its fully closed position, said method comprising the steps of:

(a) connecting said closure member to a counterweight using a first connecting member;

(b) connecting one end of a second connecting member to said counterweight;

(c) positioning a first guide members vertically above said counterweight and intermediate said closure member and said counterweight for receiving said first connecting members and guiding said first connecting member to normally move said counterweight in a vertical path of movement opposite to the direction of movement of said closure member; and (d) securing the other end of said second connecting member at a fixed location outside of said vertical path of movement of said counterweight positioned and positioned to cause said counterweight to move in a direction of movement that is at an angle to said normal vertical path of movement of said counterweight to vary the effective weight of said counterweight acting on said closure member.

55. A method of controlling the movement of a closure member disposed in an access opening of an enclosure as defined in claim 54, wherein said closure member is caused to automatically return to a predetermined intermediate position between the fully opened and fully closed positions of said closure member by said counterweight when is it moved away from said predetermined intermediate position toward its fully opened position.

56. In an enclosure having an interior chamber, an access opening in said enclosure providing access to said interior chamber, a closure member moveable between fully closed and fully open positions in said access opening for allowing and selectively restricting said access to said interior chamber, the improvement comprising:

(a) at least one counterweight;

(b) a pulley located between said counterweight and said closure member, said pulley being formed with two sides that extend radially outwardly along gradually diverging extents to form a groove therebetween that gradually increases from the inner edge of the groove to the outermost edge of the pulley; and (c) a connecting member interconnecting said closure member and said counterweight and disposed in said groove of said pulley, said connecting member having a first segment having a first predetermined width joined to a second segment having a second predetermined width that is less that the first predetermined width, whereby the effective weight of said counterweight as applied to the weight of said closure member is varied depending on which of first or second segments are disposed in said groove of said pulley.

57. The improvement according to claim 56, wherein said first segment of said connecting member is joined to said second segment of said connecting member by an intermediate transition segment, and wherein said intermediate transition segment is disposed within the groove of said pulley when said closure member is located at a predetermined intermediate position between its fully opened and fully closed positions.

* * * * *